US011353278B2

(12) United States Patent
Williams

(10) Patent No.: US 11,353,278 B2
(45) Date of Patent: Jun. 7, 2022

(54) SYSTEMS AND METHODS FOR FIREARM AIM-STABILIZATION

(71) Applicant: HYDRA CONCEPTS, San Carlos, CA (US)

(72) Inventor: Peter Todd Williams, San Carlos, CA (US)

(73) Assignee: Hydra Concepts, San Carlos, CA (US)

( * ) Notice: Subject to any disclaimer, the term of this patent is extended or adjusted under 35 U.S.C. 154(b) by 292 days.

(21) Appl. No.: 16/349,395

(22) PCT Filed: Apr. 30, 2019

(86) PCT No.: PCT/US2019/030021
§ 371 (c)(1),
(2) Date: May 13, 2019

(87) PCT Pub. No.: WO2019/213149
PCT Pub. Date: Nov. 7, 2019

(65) Prior Publication Data
US 2020/0182580 A1 Jun. 11, 2020

Related U.S. Application Data

(60) Provisional application No. 62/684,068, filed on Jun. 12, 2018, provisional application No. 62/667,538, (Continued)

(51) Int. Cl.
*F41A 21/32* (2006.01)
*F41G 3/00* (2006.01)
*F41G 11/00* (2006.01)

(52) U.S. Cl.
CPC ..... *F41A 21/32* (2013.01); *F41G 3/00* (2013.01); *F41G 11/00* (2013.01)

(58) Field of Classification Search
CPC ..... F41A 21/32; F41G 3/00; F41G 11/00
See application file for complete search history.

(56) References Cited

U.S. PATENT DOCUMENTS 4,457,206 A * 7/1984 Toulios ..... F41A 21/32 244/3.14
5,631,437 A * 5/1997 LaVigna ..... F41A 27/30 89/14.05

(Continued)

FOREIGN PATENT DOCUMENTS

WO WO 2016/046190 A1 3/2016

OTHER PUBLICATIONS

Jaramaz, S., et al., "Two-phase flows in gun barrel: Theoretical and experimental studies," *International Journal of Multiphase Flow* 37:475-487, Elsevier, Serbia (Jan. 25, 2011) (13 pages).

(Continued)

*Primary Examiner* — Michelle Clement
(74) *Attorney, Agent, or Firm* — Sterne, Kessler, Goldstein & Fox P.L.L.C.

(57) ABSTRACT

A firearm having an aim-compensation system. The firearm includes a barrel and is configured to fire a projectile. The firearm further includes a sensor disposed on the firearm that determines an orientation of the firearm. The firearm further includes a control unit that determines an intended point-of-aim of the firearm and an actual expected point-of-aim of the firearm based on the orientation of the firearm, and the control unit determines a differential of the intended point-of-aim and the actual expected point-of-aim. The firearm further includes a muzzle device arranged on the barrel which is in communication with the control unit, wherein, when the projectile is fired, the muzzle device directs a gas toward the projectile in an amount and direction based on the differential determined by the control unit so as to exert an (Continued)

aerodynamic force on the projectile to alter the trajectory of the projectile towards the intended point-of-aim.

17 Claims, 39 Drawing Sheets

Related U.S. Application Data filed on May 6, 2018, provisional application No. 62/664,707, filed on Apr. 30, 2018.

(56) References Cited

U.S. PATENT DOCUMENTS

| | | | | |
|---|---|---|---|---|
| 5,631,438 | A | 5/1997 | Martel | |
| 5,911,568 | A * | 6/1999 | Kirschner | F41A 35/04 42/1.14 |
| 6,298,764 | B1 | 10/2001 | Sherman et al. | |
| 6,964,220 | B1 | 11/2005 | Lavin | |
| 8,393,259 | B2 | 3/2013 | Larue | |
| 8,567,300 | B1 | 10/2013 | Cler | |
| 9,010,002 | B2 | 4/2015 | Popa-Simil | |
| 9,151,574 | B2 | 10/2015 | Lowrey, III | |
| 9,212,861 | B2 * | 12/2015 | Panak | F41G 3/12 |
| 9,250,035 | B2 * | 2/2016 | Sullivan | F41G 3/12 |
| 9,395,155 | B1 | 7/2016 | Bockmon | |
| 9,612,088 | B2 | 4/2017 | Theriault | |
| 9,823,047 | B2 * | 11/2017 | Lupher | F41A 17/06 |
| 9,915,496 | B2 | 3/2018 | Bergeron | |
| 9,995,551 | B2 | 6/2018 | Whitfield, Jr. | |
| 10,119,780 | B1 * | 11/2018 | Bergeron | F42B 12/74 |
| 10,184,758 | B2 * | 1/2019 | Lyren | F41G 3/142 |
| 10,415,925 | B2 * | 9/2019 | Warren | F41B 11/64 |
| 2004/0244571 | A1 | 12/2004 | Bender | |
| 2005/0188829 | A1 | 9/2005 | Hanslick et al. | |
| 2013/0098235 | A1 | 4/2013 | Reinken | |
| 2015/0043700 | A1 * | 2/2015 | Rosso | G21B 1/15 376/101 |
| 2015/0204636 | A1 * | 7/2015 | Lee | G01C 3/02 235/404 |
| 2015/0226524 | A1 | 8/2015 | Batchvarov | |
| 2015/0308771 | A1 * | 10/2015 | Marr | F41A 21/32 42/84 |
| 2015/0308777 | A1 * | 10/2015 | Panak | F41G 3/12 89/14.3 |
| 2015/0323286 | A1 * | 11/2015 | Theriault | F42B 12/38 42/111 |
| 2016/0161212 | A1 * | 6/2016 | Bergeron | F41A 21/02 124/73 |
| 2016/0187094 | A1 * | 6/2016 | Bockmon | F41G 3/165 42/111 |
| 2016/0245613 | A1 * | 8/2016 | Grossnickle | F41A 31/00 |
| 2017/0097216 | A1 * | 4/2017 | Sullivan | F42B 10/32 |
| 2017/0284772 | A1 * | 10/2017 | Beckman | F41G 3/2644 |
| 2018/0135949 | A1 | 5/2018 | Lundgren et al. | |
| 2019/0178606 | A1 * | 6/2019 | Warren | F41A 13/02 |
| 2020/0166309 | A1 * | 5/2020 | Panas | F41G 1/473 |
| 2020/0208943 | A1 * | 7/2020 | Daly | F41G 1/00 |
| 2021/0389074 | A1 * | 12/2021 | Reis-Green | F41A 21/325 |
| 2021/0389076 | A1 * | 12/2021 | Turnblom | F41A 21/30 |
| 2021/0389086 | A1 * | 12/2021 | Bilbrey | F41G 3/00 |

OTHER PUBLICATIONS

Strohm, Luke S., "An Introduction to the Sources of Delivery Error for Direct-Fire Ballistic Projectiles," *Army Research Laboratory*, ARL-TR-6494, Maryland, United States (Jul. 2013) (36 pages).

Moss, "The U.S. Army is Testing Aim-Stabilized Weapons," Popular Mechanics (Oct. 24, 2016) (7 pages).

International Search Report and Written Opinion in PCT/US2019/30021 dated Jul. 12, 2019 (16 pages).

* cited by examiner

SYSTEMS AND METHODS FOR FIREARM AIM-STABILIZATION

FIELD OF THE INVENTION

The present invention relates to systems and methods for firearm aim-stabilization. Specifically, the present invention relates to systems and methods for firearm aim-stabilization including a muzzle device that uses exhaust gases to adjust the trajectory of a projectile or to adjust the positioning of a barrel of the firearm to correct firearm pointing errors.

BACKGROUND OF THE INVENTION

For unguided, "dumb" projectiles such as bullets or artillery shells fired from barrels, the precision with which the projectile may be directed towards its intended target is often limited by practical matters related to holding the barrel steady. For example, in many if not most real-world applications, the precision with which a firearm marksman may hit or approach hitting a target is limited by the ability of the marksman to hold a firearm steady. This is especially true at intermediate distances of about 30 to 300 yards, a range of distances sufficiently broad to encompass most practical rifle applications. Within this range of distances, a well-maintained quality rifle designed for accuracy can intrinsically shoot with far greater precision than most novice or intermediate-skilled marksmen can achieve, especially without a steady bench rest. At farther distances, other factors such as cross-winds may become significant, but the ability to hold steadily on-target is still a significant factor. For realistic applications in the field at intermediate distances, in which the marksman may not have a suitable steady bench rest to shoot from, the ability to hold point-of-aim (POA) dominates the error budget. Especially from a standing or offhand position, for example, the accuracy of a marksman is almost entirely determined by factors extrinsic to the firearm itself, rather than the internal mechanics of the firearm. This problem is compounded by the nervous physiological jitters and shakes that a soldier, police officer, or hunter may have when firing at an enemy, assailant, or animal.

Similar limitations are present in the case of larger arms, such as cannons fielded by machinery. Although psychological and physiological limitations of the operators of such devices are less of a factor than in the case of small arms, machinery such as tanks and airframes are subject to unpredictable vibrations, shakes, and changes of direction that confound the problem of precisely aiming projectiles. Even stationary artillery pieces may require small, fast adjustments in aiming due to motion of the target relative to the firearm.

A fairly representative fiducial figure-of-merit for the intrinsic accuracy of a rifle given a certain fixed and standardized good-quality cartridge matched to the rifle is one minute of arc (MOA), i.e., $1/60^{th}$ of a degree, equivalent to 0.291 milliradians, or ±1.05" (plus or minus about one inch) from POA at a range of 100 yards. A very accurate rifle and load combination may greatly exceed this accuracy, reaching ±0.2" or even less at 100 yards, but one MOA is still a fairly reasonable "good" fiducial intrinsic accuracy. This is comparable to the accuracy due to extrinsic factors (holding steady POA) for a moderately well-trained marksman at a dedicated shooting bench rest, using an optical aiming aid mounted on the rifle, in the form of a magnifying rifle scope.

However, accuracy notably degrades from this fiducial standard when the marksman fires not from a bench rest but (in order of increasing difficulty) from the prone position, the kneeling position, and the standing or offhand positions. Particularly with marksmen of only moderate training or ability operating under psychological stress and/or physical exhaustion and fatigue, accuracy may degrade leading to a CEP (circular error probable) from between approximately ±6" while prone (at a range of 100 yards) to as much as ±12", ±24" or more depending upon the shooter and the circumstances while standing (almost seven milliradians). This drastically reduces the effective range of engagement with targets of a fixed size. Since the area on the ground covered within range of a firearm is proportional to the square of the effective range of engagement, this is a significant problem.

Accordingly, there is a need for a system and method for making small corrections to the aiming of the barrel of a rifle and/or the trajectory of a bullet, in order to compensate for the extrinsic factors mentioned above, and to do so without making the overall weapon heavy, cumbersome, overly complicated or expensive.

SUMMARY OF THE INVENTION

Some embodiments described herein relate to a method and device for correcting firearm pointing errors using a system that exerts lateral gas-dynamic forces upon a projectile (e.g., a bullet or shell) immediately after it leaves the muzzle of a firearm, such as in the case of a firearm that uses gunpowder or otherwise uses high-pressure gas to propel a projectile. The lateral gas-dynamic forces are modulated by a central microprocessor control unit in accordance with inputs to the control unit from a system of sensors, such as inertial and/or optical sensors that detect the orientation of the firearm and/or changes in the orientation thereof. In an embodiment, the lateral gas-dynamic forces exerted upon the projectile are generated by high-pressure gases, such gases already nominally being present but here directed by a muzzle device. The high-pressure gases originate from the barrel and flow out of its muzzle as the firearm is fired.

In an embodiment, high-pressure gas is allowed to escape radially outwards (up, down, left, right, and combinations thereof, as seen from the chamber and looking towards the muzzle) immediately after it exits the barrel, escaping preferentially towards one side (up, down, left, right or a combination thereof) or another so as to induce lateral forces upon the projectile, and/or the high-pressure gas is controlled such that there is greater gas pressure on one side of the projectile than the opposing side.

In an embodiment, the gas may be directed or controlled by way of multiple control surfaces such as vanes, flaps, or ports which are operated by actuators such as servomechanisms or piezoelectric actuators. In an embodiment, the vanes, flaps, ports and/or other control surfaces that modulate and/or direct the flow and/or the pressure of the muzzle gas are powered electrically and controlled by the central microprocessing control unit that receives input on the orientation of the firearm from inertial sensors mounted on the firearm, and/or optical sensors which may be integrated into an optical sighting device, such as a rifle scope.

In an embodiment, actuation of the control surfaces may also be powered entirely or in part by high-pressure exhaust gases pushing on pistons. In an embodiment, gas flow modulators and control surfaces may be actuated by push-rods and attached pistons that are hydraulically actuated by a separate device, such as a gas piston block with internal modulating pistons.

In an embodiment, the central microprocessing control unit (i.e., control system) determines ballistic corrections by applying an averaging process or other digital signal processing process such as a smoothing process, such as a Kalman filter, or a predictive process to the input signals regarding the firearm orientation, in a manner similar to the system employed in image-stabilization technology such as is used in image-stabilized binoculars as is understood by those practiced in that art. In an embodiment, the control system may be calibrated by a system providing feedback information to the control system of the effect of the actuations of the muzzle device and/or its internal components, such as control surfaces on the trajectory of the projectile.

The high-pressure gases may be sourced from the barrel and/or chamber of the firearm as it is fired, and such gases are provided to the system by means of a port or ports in the barrel and/or chamber of the firearm as is understood by those practiced in the art of gas-operated automatic or semi-automatic weapons. In an embodiment, high-pressure gas is directed radially inwards toward the projectile and immediately after the projectile exits the barrel by way of multiple nozzles or orifices.

In an embodiment, flow through the nozzles or orifices is modulated by electromechanical valves or restrictors such as constructed by servomechanisms or piezoelectric actuators. In an embodiment, flow through nozzles or orifices is modulated by control surfaces such as real control surfaces, such as vanes or flaps, similar to the actuation of control surfaces such as ailerons for aircraft, or virtual control surfaces generated by dielectric barrier discharge plasmas. In an embodiment, modulation of flow through nozzles or orifices is performed in a muzzle device. In another embodiment, modulation of the flow through nozzles or orifices is accomplished by separating the gas supply to said nozzles or orifices into separate chambers internal to the muzzle device, these chambers being separately supplied by gas from a gas block multiplexer distinct from the muzzle device and conveyed to the muzzle device by gas tubes.

Some embodiments described herein relate to a method and device for correcting firearm pointing errors using a system that exerts lateral gas-dynamic forces upon a distal part of the firearm, such as at or near the muzzle of the barrel in the case of a firearm that uses gunpowder or otherwise uses high-pressure gas to propel a projectile. In an embodiment, high-pressure gas is directed radially outwards (up, down, left, right, and combinations thereof, as seen from the chamber and looking towards the muzzle) before the projectile exits the barrel, and the gas is directed by way of multiple nozzles or orifices.

In an embodiment, the barrel of the firearm is designed to have a flexure such that the lateral forces on the muzzle cause the barrel to flex in the desired direction. In an embodiment, the barrel, possibly including action (including, e.g., bolt, breech block, trigger, sear, chamber, etc.) are affixed to a carriage, and the carriage is attached to the main body of the weapon through hinges or contact points or flexures, and/or springs and dashpots, and digital encoders (sensors), such that the muzzle device may to some practical degree re-point the carriage assembly independently of the main body, and such that the relative motion between main body and carriage may be sensed and such information conveyed to a central control system.

Some embodiments described herein relate to a firearm having an aim-stabilization system including a firearm having a barrel that is configured to fire a projectile, a sensor disposed on the firearm that is configured to determine an orientation of the firearm, a control unit configured to determine an intended point-of-aim of the firearm and an actual point-of-aim of the firearm based on the orientation of the firearm as determined by the sensor, wherein the control unit determines a difference between the intended point-of-aim and the actual point-of-aim. The firearm further includes a muzzle device arranged on the barrel of the firearm, wherein the muzzle device is in communication with the control unit, and wherein, when the projectile is fired, the muzzle device is configured to direct a gas toward the projectile in an amount and direction based on the differential determined by the control unit so as to exert an aerodynamic force on the projectile to alter the trajectory of the projectile towards the intended point-of-aim.

Some embodiments described herein relate to a firearm having an aim-compensation system, that includes a firearm having a barrel, wherein the firearm is configured to fire a projectile, a sensor disposed on the firearm that is configured to determine an orientation of the firearm, a control unit configured to determine an intended point-of-aim of the firearm and an actual point-of-aim of the firearm based on the orientation of the firearm as determined by the sensor, wherein the control unit determines a differential between the intended point-of-aim and the actual point-of-aim, and a gas block configured to receive high pressure gas from the barrel when the projectile is fired. The firearm further includes a muzzle device connected to the gas block and comprising orifices, wherein the muzzle device is arranged on the barrel of the firearm, and wherein the muzzle device is in communication with the control unit such that when the projectile is fired, the muzzle device is configured to direct gas communicated to the muzzle device by the gas block outwardly through one or more of the orifices of the muzzle device in an amount and direction based on the differential determined by the control unit so as to exert a force on the barrel to direct the projectile towards the intended point-of-aim.

Some embodiments described herein relate to A method of aim-stabilization for a firearm, that includes determining, by means of a sensor arranged on the firearm, a first orientation of the firearm corresponding to an intended point-of-aim, determining, by means of the sensor arranged on the firearm, a second orientation of the firearm at the time the firearm is fired, determining, by means of a control unit of the firearm, a differential between the first orientation and the second orientation, and inducing, by means of a muzzle device of the firearm, an aerodynamic force on the projectile by directing a gas toward the projectile in an amount and direction based on the differential determined by the control unit such that a trajectory of the projectile is altered to direct the project toward the intended point-of-aim.

In any of the embodiments described herein, the firearm may be a rifle.

In any of the embodiments described herein, the intended point-of-aim may be estimated by the control unit based on measurements of the orientation of the firearm over a period of time.

In any of the embodiments described herein, the sensor may be an inertial sensor, an optical sensor, multiple inertial sensors and/or multiple optical sensors. In some embodiments, the sensor may be an optical sensor that is incorporated into a riflescope of the firearm.

In any of the embodiments described herein, the muzzle device may include an outer cylinder spaced from an inner cylinder, and the inner cylinder may have a plurality of orifices that are selectively covered by valve gates configured to modulate a flow of gas through the plurality of orifices.

In any of the embodiments described herein, the muzzle device may include a cylindrical muzzle shroud having orifices and a valve gate plate having orifices, and the valve gate plate may be configured to be linearly actuated so as to selectively align the orifices of the valve gate plate with the orifices of the cylindrical muzzle shroud so as to modulate a flow of gas through the orifices of the cylindrical muzzle shroud.

In any of the embodiments described herein, the muzzle device may include an outer cylinder and an inner gas guide cylinder supported within the outer cylinder by an active motor assembly configured to selectively position the inner gas guide cylinder within the outer cylinder.

In any of the embodiments described herein, the muzzle device may have conical baffles adjustably positioned within an outer cylinder.

In any of the embodiments described herein, the firearm may include a gas piston block configured to receive gas from the barrel via a gas port or ports, and the gas piston block may be configured to actuate push rods that are connected to the muzzle device for modulating a flow of gas through the muzzle device. In some embodiments, the muzzle device may include a baffle cone body that is actuated by the push rods.

In any of the embodiments described herein, the gas block may communicate gas to the muzzle device via a gas tube or tubes.

In any of the embodiments described herein, the firearm may further include a gas block multiplexer configured to receive gas from the barrel and distribute the gas via gas tubes to the muzzle device.

In any of the embodiments described herein, the muzzle device may include nozzles and electromechanical valves that modulate a flow of gas through the nozzles.

In any of the embodiments described herein, the muzzle device may include nozzles and virtual control surfaces for modulating a flow of gas through the nozzles.

In any of the embodiments described herein, the muzzle device may include nozzles, and each of the nozzles may comprise a divergent section and a convergent section.

In any of the embodiments described herein, the firearm may include a gas filter block configured to receive gas from the gas block via a gas tube.

In any of the embodiments described herein, the muzzle device may include selectively actuatable control surfaces configured to modulate a flow of gas through the orifices of the muzzle device.

BRIEF DESCRIPTION OF THE DRAWINGS

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION OF THE INVENTION

Figure 1:
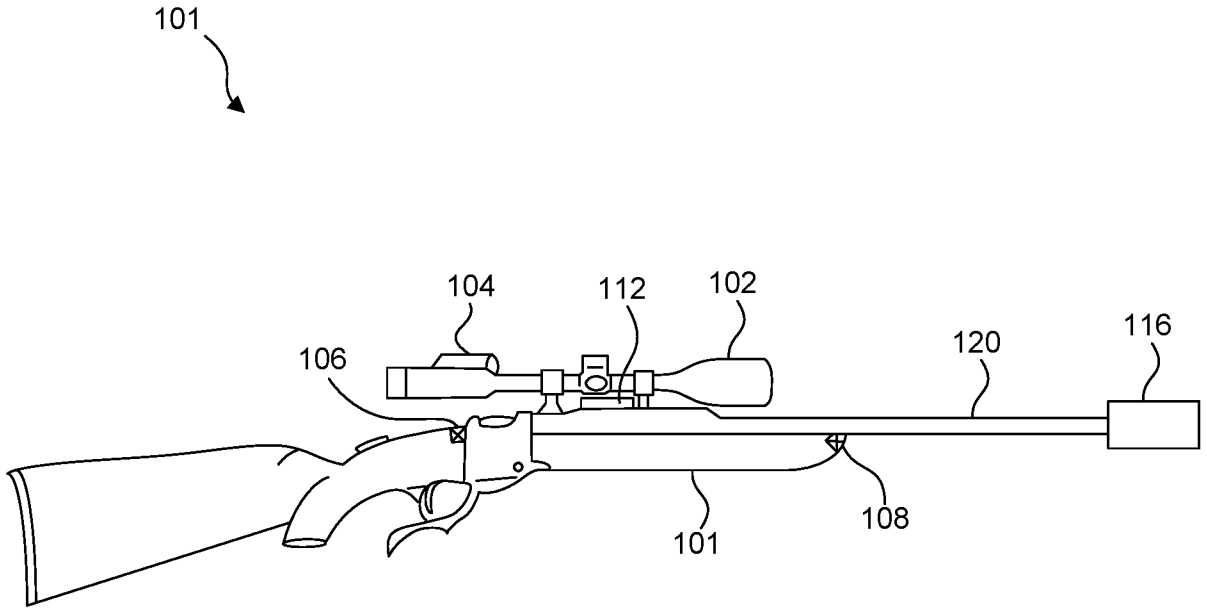
FIG. 1 shows a view of a firearm having an aim-stabilization system according to an embodiment.

Reference will now be made in detail to representative embodiments illustrated in the accompanying drawing. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

The invention disclosed herein relates to firearms for firing projectiles, including both small arms such as gunpowder rifles and rifles that use air pressure to accelerate a projectile, as well as larger guns such as military cannons. For concreteness, the focus of the main embodiments is gunpowder guns, and specifically rifles. In some embodiments, the invention relates to modifications and additions to rifles to increase their accuracy. In some embodiments, the invention includes a system that combines sensors, microprocessing, gas flow multiplexing, and a muzzle device to actively make small corrections to the trajectory of a projectile after it leaves the barrel of a firearm, or to the pointing of the barrel before the projectile leaves the barrel, by exerting substantially lateral gas-dynamic forces on the projectile or on or near the muzzle of the barrel to redirect the barrel, so that the projectile fired from the weapon may hit, or more nearly approach hitting, the target as intended by the operator.

While the focus of the embodiments as discussed herein is on gunpowder hand-held rifles, the present disclosure is not restricted to small arms, and can be applied to larger-caliber guns, including guns, cannons, or artillery that may be fixed or mounted on machinery such as tanks, aircraft, or ships. Further, the present disclosure may also be extended to guns such as airguns that use other pressurized gases. With additional modification, provided some other source or reservoir of high-pressure gas, the invention may also be applied to firearms that use rails instead of barrels, and firearms that accelerate projectiles with other forces, such as electromagnetic forces, instead of gas pressure.

The aim compensation system described herein may be added onto an existing firearm with minimal alteration of the firearm itself, or a firearm may be manufactured such that the aim compensation system is integral therewith. The present invention further relates to methods to determine the intended point-of-aim (POA) of the marksman or a method, such as signal processing (such as a Kalman filter) to approximate the same, and a method to determine the corrections and adjustments required to attain that intended POA. The present disclosure focuses on devices and methods for altering the actual POA (APOA) of the weapon so that it coincides with the intended POA. As used herein, APOA refers to the point on the target plane where the projectile would hit (or cross) that plane were the firearm fired without the projectile's trajectory being altered. Nominally, only azimuth $\alpha$ and elevation $\lambda$ of the barrel may be expected to affect the exterior ballistics, whereas cant $\beta$, defined here as rotation about the axis of the barrel, does not. In practice however, as the optical sighting system is not coincident with and possibly not parallel to the bore, and as the corrections must be applied within the coordinate system fixed to the weapon, cant $\beta$ is also an important input to the system. As well, position in space, acceleration thereof, and acceleration of orientation degrees of freedom ($\alpha$, $\lambda$, $\beta$) may also be required.

Some embodiments described herein relate to a method and system to make adjustments to the trajectory of a projectile after it leaves the muzzle of a firearm, referred to herein as "aim-compensation" or "aim-stabilization" using lateral gas-dynamic forces applied to the projectile using the muzzle gas that exits the muzzle as the firearm is fired. Such forces may be generated by directing high-pressure gases substantially radially-inwards (that is, up, down, left, right, as viewed by the operator located near the breech of the gun) to impart vertical or lateral forces on the projectile, or by directing the flow in axial direction but with greater intensity on one side of the projectile than the other so as to induce lateral pressure forces due to combinations of the Bernoulli effect and the Coanda effect, or by selectively inhibiting the flow of the gas from being radially-outwards, or by the modulation of real or virtual control surfaces that cause a relative pressure gradient from one side (up, down, left, right, or combinations thereof) to the other of the projectile, such as by the use of surfaces to selectively cause or modulate shock reflection on or in the vicinity of the projectile, or some combination of any or all of these methods. The quantity of gas and/or its pressure being modulated by a control device in such manner as to correct for variations in the pointing of the barrel that would otherwise have deleterious effects on the accuracy with which the projectile approaches hitting the intended target. In an embodiment, the high-pressure gases are generated by the burning gunpowder in the case of a rifle.

The aforementioned adjustments to the trajectory of the projectile are made so as to aid the marksman to hit or more nearly approach hitting his intended target, by correcting or compensating for small dynamic pointing errors (such as shaking) that might normally otherwise cause the marksman to miss the target. The system includes a central microprocessing control unit configured to determine the adjustments to be made, in accordance with inputs to the central microprocessing control unit on the orientation, and/or change of orientation, of the rifle. The inputs to the microprocessing unit are provided by microelectronic inertial sensors such as 6-DOF (Six Degrees of Freedom) sensors mounted on the firearm, and/or by an optical system such as an electro-optical detector integrated into an optical sighting aid (e.g., a rifle scope).

In some embodiments described herein, the aim compensating system incorporates a muzzle device with multiple orifices or nozzles arrayed pointing substantially inwards toward the projectile in its trajectory out of the muzzle. In an embodiment, gas such as exhaust gas from combustion of gunpowder is conveyed forward to the muzzle device by a gas tube or tubes. In one embodiment, the muzzle device possesses multiple internal gas chambers leading to different respective arrays of nozzles. In another embodiment, the muzzle device has a single internal gas chamber, but multiple internal valves or control surfaces that modulate flow to or through the nozzles. In one embodiment, there is a gas manifold multiplexer with electronically-actuated valves or control surfaces to control the gas flow to each of these chambers. In another embodiment, the gas multiplexer is a separate unit, attached on the gun barrel proximally to the gun action from the muzzle device, and multiple gas tubes convey gas from the multiplexer to the separate gas chambers in the muzzle device. In one embodiment, high-pressure gas is provided to the gas multiplexer through a lateral orifice in the gun barrel, similar to the orifice and gas block construction of gas-operated automatic or semi-automatic weapons such as the US Army M4 carbine or the civilian AR-15.

In one embodiment, a gas multiplexer block contains multiple valves and/or gas control surfaces to direct the gas pressure and flow in modulated quantity to each of the gas tubes. In another embodiment, the gas multiplexer is integral to the muzzle device itself, in which case there may be only one gas tube leading to the muzzle device. In such embodiments, there may be multiple chambers leading to distinct nozzles in the device, or there may be a single chamber but distinct valves or control surfaces to modulate flow through the nozzles. In another embodiment, in addition to conveying gas to the muzzle device, the gas block contains multiple pistons that actuate valves on the muzzle device and thereby modulate flow through the nozzles internal to the muzzle device, or which operate vanes, flaps or other control surfaces and thereby redirect and/or modulate the flow through the nozzles and/or orifices of the muzzle device.

In some embodiments, a muzzle device may be attached near the muzzle of the firearm, with multiple orifices or nozzles arrayed pointing substantially outwards. In an embodiment, gas such as exhaust gas from combustion of gunpowder is conveyed forward to the muzzle device by a gas tube or tubes. In one embodiment, the muzzle device possesses multiple internal gas chambers leading to different respective arrays of nozzles. In another embodiment, the muzzle device has a single internal gas chamber, but multiple internal valves or control surfaces that modulate flow to or through the nozzles. In an embodiment, there is a gas manifold multiplexer with electronically-actuated valves or control surfaces to control the gas flow to each of these chambers. In another embodiment, the gas multiplexer is a separate unit, attached on the gun barrel proximally to the gun action from the muzzle device, and multiple gas tubes convey gas from the multiplexer to the separate gas chambers in the muzzle device.

As used herein, "muzzle device" means a device attached to a projectile-firing or launching weapon at or near the distal end of a projectile-guiding structure of the weapon such as the muzzle of a barrel in the case of a gun or such as the distal end of a rail or other projectile-guiding structure in the case of a rail gun, and secondly, which satisfies additional criteria as described below. This first definition includes the conventional meaning of "muzzle device" such as used in the field of small arms, being understood to be a device attached directly to the muzzle of a rifle either by being threaded ("screwed") onto the barrel or by a lug mechanism, such as is known to those practiced in the art of designing suppressors (silencers). This definition also includes more broadly, however, devices that may be attached to the barrel, rail, or the like further back from the muzzle itself (in the case of a barrel), but still in the distal part of the barrel (or rail, etc.), rather than proximally, near the chamber end. In this sense, for example, the gas block of an AR-15 style rifle would be understood, for the purposes of this document, to be a "muzzle device," as it is attached and located closer to the muzzle of the barrel than to the chamber. Secondly, a muzzle device is a device intended to apply gas-dynamic forces to the projectile using the muzzle gas that exits the muzzle as the firearm is fired. The muzzle device may, for example, direct gas, radially inwards or outwards (up, down, left, right, and combinations thereof, as seen from the proximal end of the projectile-guiding structure, e.g., as seen from near the breech and looking towards the muzzle), or may direct flow axially but with more intensity or pressure on one side of the projectile, such as to affect the intended deflection of a projectile and/or pointing of the muzzle and/or barrel (rail, etc.) of the weapon and/or the weapon itself.

Some embodiments described herein relate to a firearm 101 as shown in FIG. 1. Firearm 101 includes one or more sensors 104, 106, 108. Sensors may include inertial sensors 106 and 108 positioned on the firearm 101. For example, a first sensor may be positioned on a body of the firearm 101 and a second sensor may be positioned on the barrel 120 thereof. The orientation of the firearm 101 may be able to be more accurately maintained if the inertial sensors are widely spaced, such as on a butt-end of the rifle and on a barrel of the rifle. In some embodiments, the inertial sensors may be accelerometers, gyroscopes, 6 degrees-of-freedom (6DOF) sensors, or a combination of these types of sensors, among others. The relative positioning of a first and second sensor allows for determination of an orientation of firearm 101, and thus a point of aim of the firearm. In some embodiments, three or more sensors may be provided to further assist in determining an orientation and point of aim of the firearm.

In some embodiments, sensors may alternatively or additionally include an optical sensor, such as a digital optical sensor 104. The digital optical sensor 104 may be integrated into a sighting device 102, such as a riflescope, wherein the point of aim of firearm 101 may be determined by the digital optical sensor.

The sensors 104, 106, 108 deliver signals, either wirelessly or via wires to a central microprocessing control unit 112. The control unit 112 may be located on the firearm as shown in FIG. 1, such as on the body of the firearm, or in some embodiments control unit 112 may be located remotely. Based on the information from the sensors 104, 106, 108, the control unit 112 determines: the intended point of aim (POA) based on the an estimate of the intended orientation of the firearm, the actual point of aim (APOA) based on the orientation of the firearm at the time the rifle is fired, and a differential between the POA and APOA. In accordance with internal algorithms to arrive at a best estimate of required corrections to adjust the APOA to coincide with the intended POA, the central microprocessing control unit 112 sends electronic signals to a muzzle device 116 mounted on muzzle of barrel 120, so that muzzle device 116 may alter the trajectory of the projectile based on the determined differential such that the projectile hits, or more nearly hits, the intended POA. In some embodiments, control unit 112 determines a first orientation of the firearm corresponding to the intended POA of the firearm, and further determines a second orientation of the firearm, such as at the time the firearm is fired, and the control unit 112 determines the difference between the first orientation and the second orientation and alters the trajectory of the projectile as necessary to direct the projectile towards the intended POA corresponding to the first orientation of the firearm.

In an embodiment, the central microprocessing control unit 112 determines ballistic corrections by applying an averaging process or other digital signal processing process such as a smoothing process or a predictive process, such as a Kalman filter, to the input signals from the sensors regarding the firearm orientation and point of aim. Kalman filtering, also referred to as linear quadratic estimation (LQE), is an algorithm that uses a series of measurements observed over a period of time to provide an estimate for a variable. Thus, control unit 112 may continuously collect data from the sensors relating to the orientation of the firearm and provide an estimate of the intended POA based on the orientation of the firearm over time as determined by the sensors. In this way, the control unit may determine the intended POA and ignore or account for minor disturbances in the orientation of the firearm toward the intended POA, which may occur from breathing, shaking, twitching and other movements of the marksman. The APOA corresponds to the orientation of the firearm at any given time, such as the orientation of the firearm at the time a projectile is fired, which may differ from the intended POA. Control unit 112 may determine a differential between the estimated intended POA and the APOA, and send a signal to muzzle device to actuate muzzle device to direct gases toward projectile (or outwardly from the muzzle device) to modify the trajectory of the projectile based on the differential.

In alternate embodiments, the intended POA may be manually selected or entered by a user. In such embodiments, firearm 101 may be positioned at a desired orientation and a user may enter an input into control unit 112, such as via a button, a lever, a switch, a capacitive sensor, or the like, to select or the intended POA. Thus, a user can aim a firearm and select the intended POA when the user has properly aimed the firearm.

In some embodiments, the intended POA may be automatically determined by an optical sensor, which may determine the intended POA based on identification of potential targets, such as by identification of a shape or silhouette of a target, e.g., a silhouette of a deer or other game animal, a heat signature of a target, a coloration, or a movement pattern or characteristic corresponding to a potential target.

In some embodiments, the intended POA may be determined based on a moving average of the orientation of the firearm. The orientation of the firearm may be continuously monitored by the sensors on the firearm, and the average orientation of the firearm over a predetermined period of time is determined and is the intended POA. In some embodiments, the predetermined period of time may be from about 0.1 second to about 5 seconds, or about 0.75 second to about 4 seconds, or about 1 second to about 3 seconds, or about 0.5 second to about 1 second. Even while holding the firearm steady, the orientation of the firearm may change to some degree due to the natural physiological tremor of a marksman, which may result in an oscillation of the firearm having a frequency of about 1 to 2 Hz. Thus, the predetermined period of time may be about 1 to 2 seconds so as to take the average position of the orientation of the firearm. If the period of time is too long, e.g., 5 seconds or more, 10 seconds or more, 20 seconds or more, etc., there will be a delay in acquiring an accurate estimate of the intended point of aim when the marksman moves the rifle to point at a new target. In some embodiments, control unit 112 may include an adjustment mechanism that allows the user to manually select the period of time. In some embodiments, the adjustment mechanism may be a dial or a digital adjustment mechanism, such that the user may increase the period of time to take the average over a longer period, or the user may decrease the period of time to 0, such that no aim-compensation or aim-stabilization is provided by the system. Further, the moving average may be an arithmetic moving average, or may be an exponentially-weighted moving average. In an exponentially weighted average, the more recent positions of the rifle are given greater weight in the average.

In some embodiments, the control unit 112 may begin determining the orientation of the firearm once the safety of the firearm is disengaged. In another aspect, the control unit 112 may stop determining the orientation of the firearm once the safety is engaged. When activated, the control unit 112 may continuously determine the position of the firearm, and the average orientation of the firearm based on the data provided to the control unit 112 by the sensors. Alternatively, the control unit 112 may determine the position of the firearm at a given interval, such as about every 0.1 seconds, or about every 0.5 seconds.

In some embodiments, the muzzle device may direct gases towards the projectile in an amount and direction based on the differential between the actual point of aim and the intended point of aim as determined by the control unit 112. For example, where the differential is relatively small, a small deflection is required for the projectile to hit the intended POA, and thus a small amount of gas may be directed towards the bullet, and where the differential is relatively large, a greater amount of gas may be directed toward the bullet to alter the trajectory to a greater extent.

In some embodiments, firearm may further include environmental sensors for detecting environmental conditions such that control unit 112 may account for such environmental conditions when altering a trajectory of a projectile from the APOA to the intended POA. Such environmental sensors may be configured to detect and determine wind velocity and direction, altitude, air pressure, and air temperature, among other ambient conditions which may impact a trajectory of a projectile.

Figure 2:
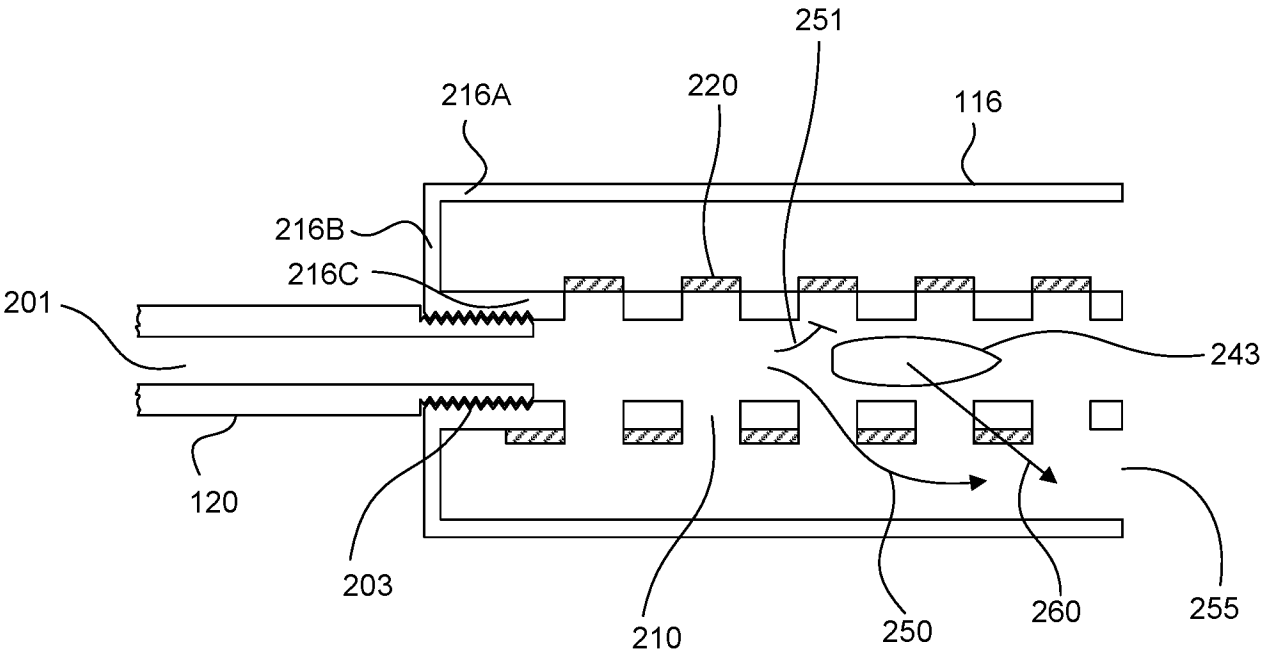
FIG. 2 shows a cross sectional view of a muzzle device of an aim-stabilization system according to the embodiment of FIG. 1.
Figure 3:
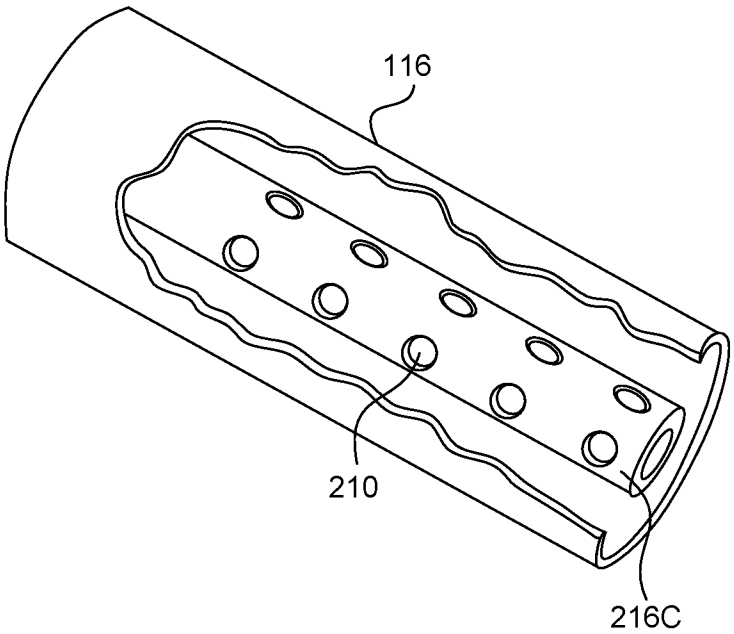
FIG. 3 shows a cut-out view of a muzzle device according to the embodiment of FIG. 1.

FIG. 2 is a longitudinal cross sectional view of the muzzle device 116 and a distal end of the barrel 120 of the embodiment of the firearm 101 as shown in FIG. 1. High-speed, high-pressure gas is supplied to the muzzle device 116 from the barrel bore 201 of the firearm 101. The muzzle device 116 may be removably attached to the barrel 120 by means of threads 203. In an alternate embodiment, the muzzle device 116 may be clamped or brazed onto the barrel 120 instead of threaded. The body of the muzzle device 116 includes an outer cylinder 216A connected to a wall plate 216B connected to an inner cylinder 216C. The outer cylinder 216A, wall plate 216B, and inner cylinder 216C may be integrally formed, or may be separate components. Inner cylinder 216C includes a plurality of rows of orifices 210, as shown for example at FIG. 3. Each orifice 210 has a valve gate 220 that is actuated by linear actuators, such as piezoelectric linear actuators. Each valve gate 220 may be in the closed position in which case it blocks the flow 251 of high-pressure muzzle gas, the open position in which case a valve gate 220 allows the flow 250 of high-pressure muzzle gas (see FIG. 2), or the valve gate 220 may be partially open, allowing but somewhat restricting the flow of high-pressure muzzle gas.

In the illustrated embodiment, such gas ultimately exits the muzzle device 116 through a common annular opening 255. If more flow is allowed on one side (up, down, left, right, as viewed from the breech of the barrel) or combination of sides, there will arise an aerodynamic force 260 on the bullet 243 such that the aerodynamic force 260 has a radially-outward component (i.e., a component perpendicular to the axis of the barrel 120) tending to push the bullet 243 laterally (that is, up, down, left, right, or some combination thereof, as viewed from the breech), so as to alter the trajectory of the bullet 243 in accordance with the algorithm of the central microprocessing control unit 112, which has determined the appropriate valve gate 220 positions in order to induce the proper corrections to the bullet trajectory so as to assist the marksman to hit or more nearly approach hitting the intended POA or target.

Figure 4:
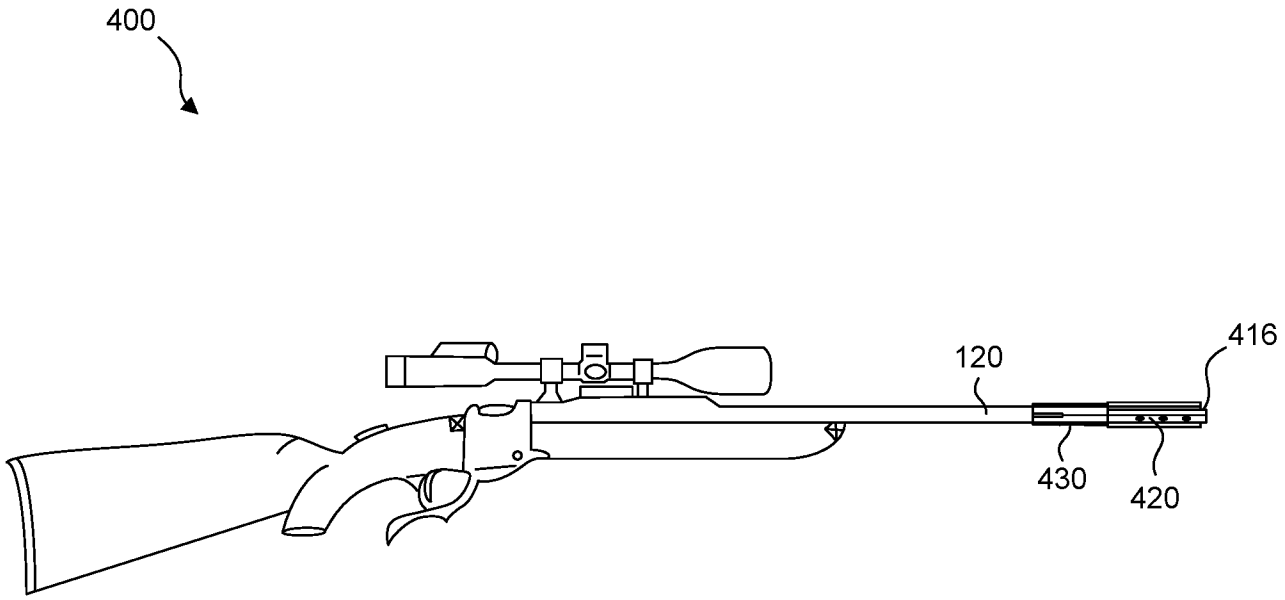
FIG. 4 shows a view of a firearm having an aim-stabilization system according to an embodiment.
Figure 5:
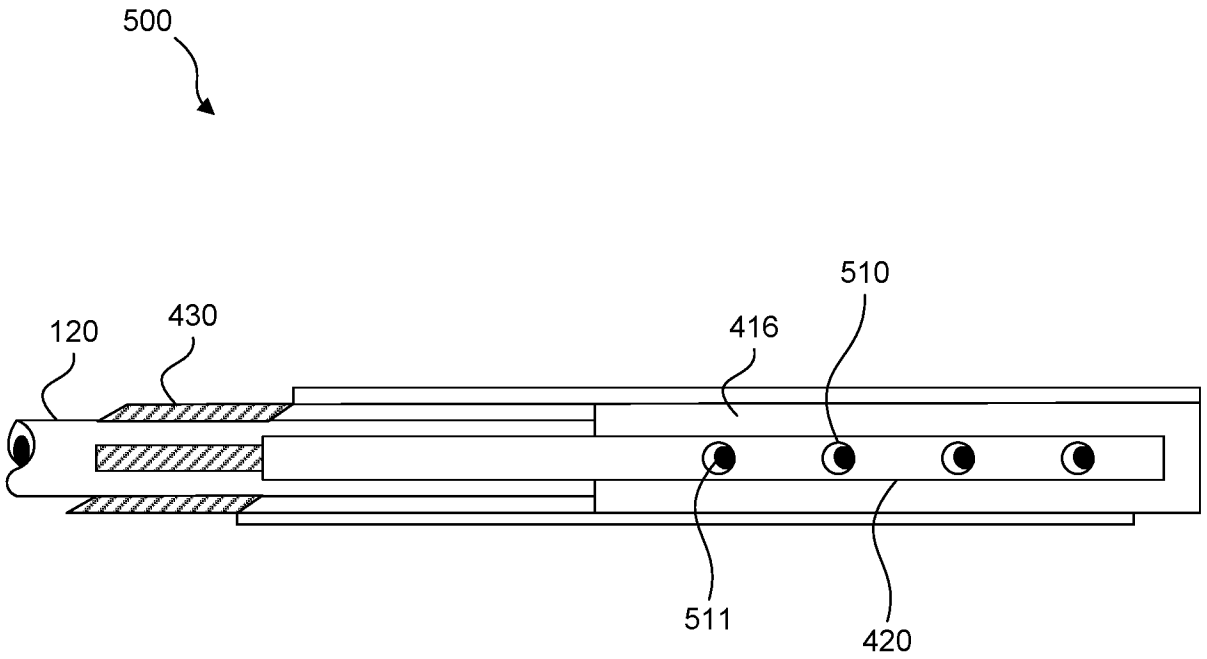
FIG. 5 shows a side view of a muzzle device according to the embodiment of FIG. 4.

FIGS. 4 and 5 illustrate an embodiment of a firearm 400 similar to the embodiment in FIG. 1, which includes a cylindrical muzzle shroud 416, and a plurality of valve gate plates 420 that may be linearly actuated by linear actuators 430. FIG. 5 is a close-up illustration of the embodiment shown in FIG. 4, detailing the components at or near the muzzle of the barrel 120. The cylindrical muzzle shroud 416, similar to inner cylinder 216C in FIGS. 2-3, has multiple rows of orifices 511 to allow high-pressure muzzle gas to escape radially outwards. Flow of such gas is valved or modulated by multiple valve gate plates 420 which have arrays of orifices 510 that, depending on position of linear actuator 430, may be made to align with orifices 511 and thereby allow high-pressure muzzle gas to escape cylindrical muzzle shroud 416 by flowing radially outward. Alternately, the linear actuator 430 may be positioned so that the valve gate plate 420 partially or wholly obstructs the flow of high-pressure muzzle gas through the orifices 511. By selectively linearly actuating each valve gate plate 420 by a different amount corresponding to signals received from the central microprocessing control unit 112 in accordance with its own internal algorithm, and subject to the signals it receives from the sensors, the embodiment may create a lateral force on the bullet 243 so as to alter its trajectory so as to make it more nearly approach hitting the intended POA. In some embodiments, valve gate plate 420 may be confined or otherwise held in place by an outer shroud or enclosure.

In some embodiments, valve gate plate may be a rotating valve gate plate. In such embodiments, rotating valve gate plate may be rotated by a servo-mechanism with a shaft drive. The valve gate plate may have a cylindrical or tubular shape, or may be in the form of a disk. Multiple rotating valve gate plates may be used, depending on the embodiment.

Figure 6A:
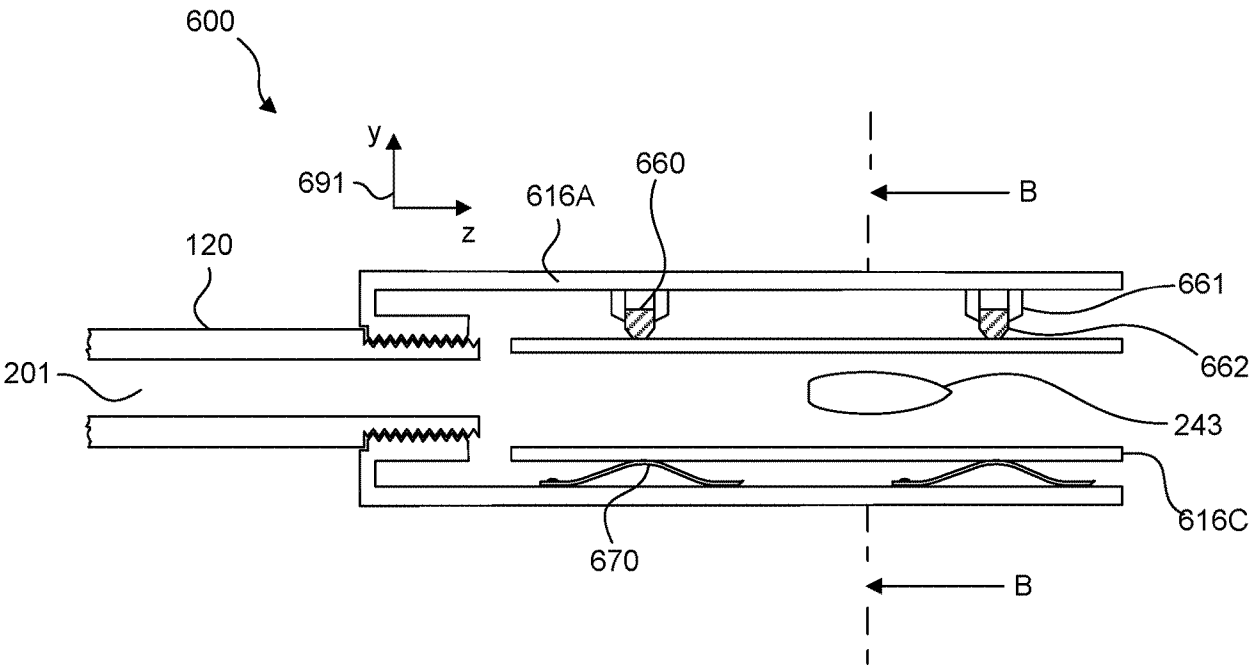
FIGS. 6A and 6B show a longitudinal cross sectional view and a transverse cross sectional view, respectively, of a muzzle device according to an embodiment.
Figure 6B:
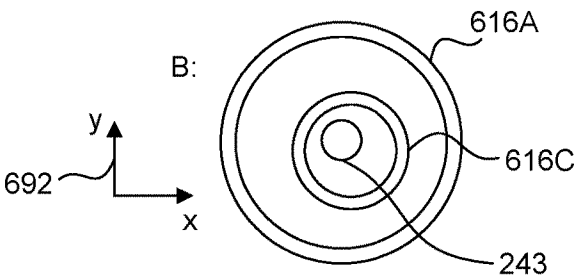

A muzzle device 600 according to an embodiment is shown in FIGS. 6A and 6B. The muzzle device 600 includes an outer cylinder 616A rigidly affixed to the muzzle of the barrel 120, and an inner gas guide cylinder 616C. For reference, an orthogonal 3D coordinate system is used, as indicated by y-z plane 691 and x-y plane 692. Inner gas guide cylinder 616C is held within outer cylinder 616A by a combination of active motor assemblies 660 and leaf springs 670. The motor assemblies 660 may include motor cylinders 661 and pistons 662. In the embodiment shown, the motor assemblies 660 are electromechanical. In another embodiment, motor assemblies 660 may be actuated by high-pressure gas sourced from the barrel bore 201. The pair of motor assemblies 660 and a pair of leaf springs 670 position the inner gas guide cylinder 616C such that coordinated actuation of the motor assemblies 660 move the inner gas guide cylinder 616C in the y-direction. There may also be an additional pair of motor assemblies 660 and leaf springs 670 to move the inner gas guide cylinder 616C in the x-direction. For example, the action of both pairs of motor assemblies 660 may be such as to position the inner gas guide cylinder 616C eccentrically in both x- and y-directions relative to the outer cylinder 616A, barrel 120 and bullet 243. High-pressure, high-speed gas from the bore 201 flows past the bullet 243 and due to the eccentric positioning of inner gas guide cylinder 616C, and due to gas-dynamic effects such as the Bernoulli effect, the ground effect, and reflected shocks, there exists a radial force (that is, a force in the x- or y-directions or some combination thereof) that alters the trajectory of the bullet 243. Inner gas guide cylinder 616C is positioned by motor assemblies 660 in accordance with signals from the central microprocessing control unit 112 and its internal algorithm, as determined by that algorithm in accordance with input from inertial sensors and/or optical sensors so as to alter the trajectory of the bullet 243 so as to induce it to hit or more nearly approach hitting the intended POA.

Figure 7:
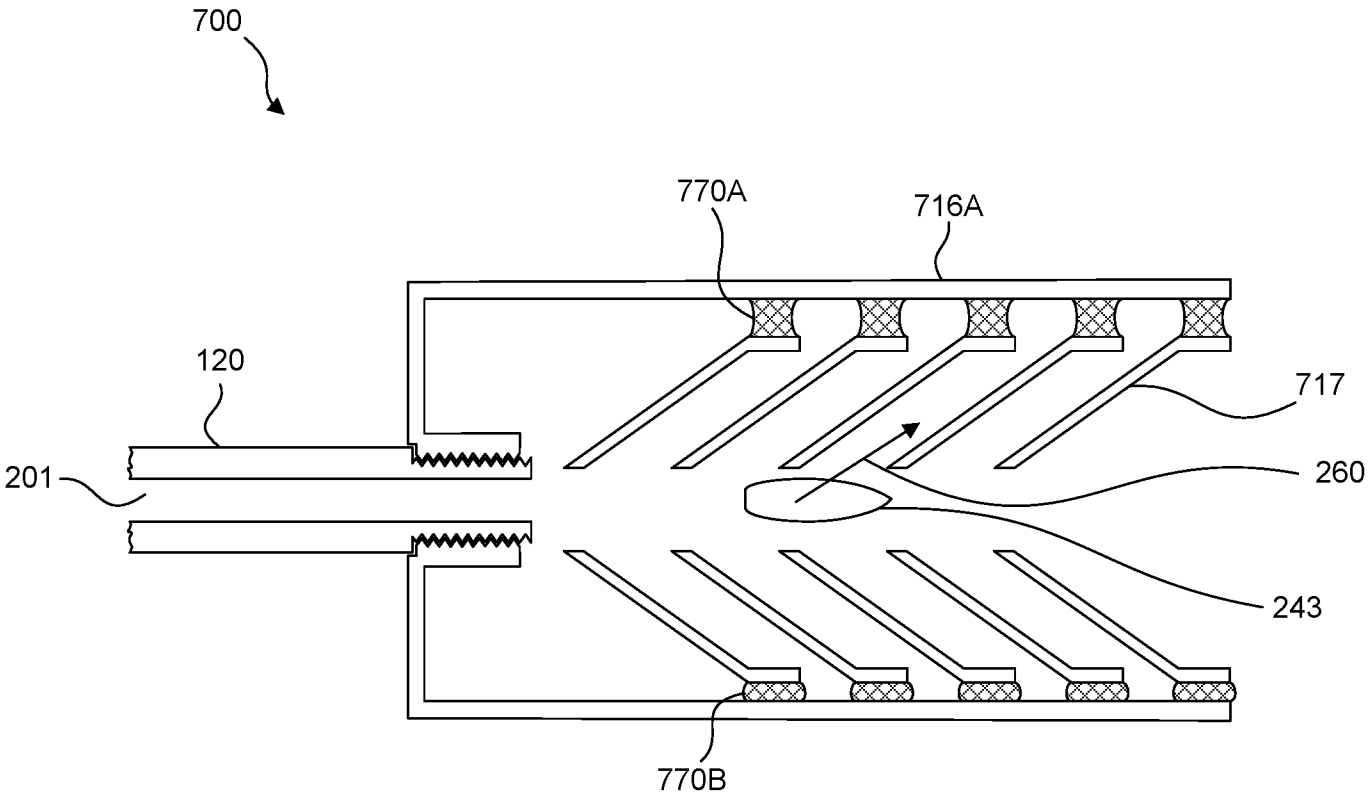
FIG. 7 shows a longitudinal cross sectional view of a muzzle device according to an embodiment.

FIG. 7 shows a muzzle device 700 according to an embodiment. The muzzle device 700 is similar to muzzle device 600 as shown in FIG. 6A but being based on a suppressor (silencer). The muzzle device 700 includes conical baffles 717 contained within an outer cylinder 716A, and positioned by piezoelectric actuators 770, which may be in extension, 770A, or contracted, 770B, or in a state in between these two extremes. According to the electrical voltage placed on piezoelectric actuators 770 and the corresponding extension or contraction of these actuators 770, the conical baffles 717 are moved radially (that is, in x- and y-directions, adopting the same coordinate system as used in FIG. 6A). This eccentric positioning of the baffles 717 acting on the high-pressure high-speed gas flowing from the bore 201 of the barrel 120 induces an aerodynamic force 260 on the bullet 243, and this force 260 has a radial component (that is, up, down, to the left, or to the right, as viewed from the breech of the firearm, or some combination of these directions) that alters the trajectory of the bullet 243 in accordance with the signals from the central microprocessing control unit.

Figure 8:
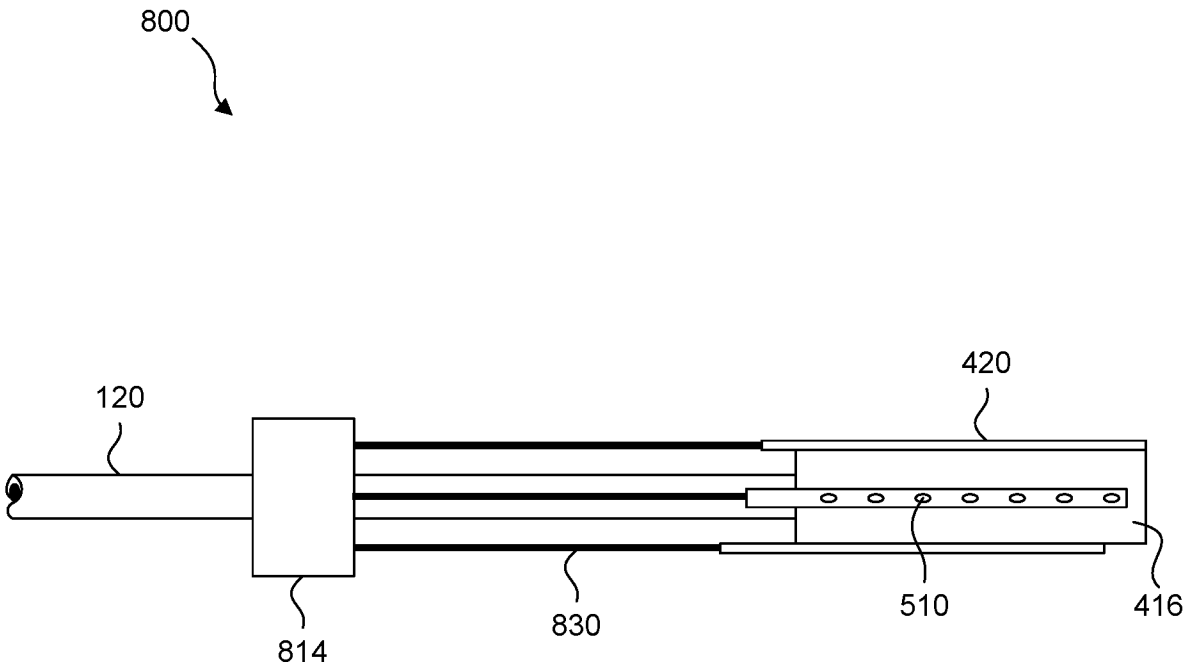
FIG. 8 shows a side view of a muzzle device and a gas piston block according to an embodiment.

A muzzle device 800 and barrel 120 according to another embodiment is shown in FIG. 8. Muzzle device 800 includes a gas piston block 814, which sources gas from the bore of the barrel 120 through a gas port as is understood by those knowledgeable in the art of gas-operated semiautomatic rifles such as the AR-15. The gas piston block 814 contains multiple pistons that are selectively pushed or actuated by the high-pressure gas sourced from the barrel 120 in accordance with signals received from the central microprocessing control unit 112. The pistons push on push-rods 830. The push-rods 830 selectively push on gate valve plates 420, each possessing a row of orifices 510, that may allow gas to exit through the muzzle device body 416 in a similar manner as shown for the muzzle device 500 as illustrated in FIGS. 4 and 5. By selectively allowing gas to escape on one side more than on another side, the device may induce a radial gas-dynamic force on the bullet 243.

Figure 9:
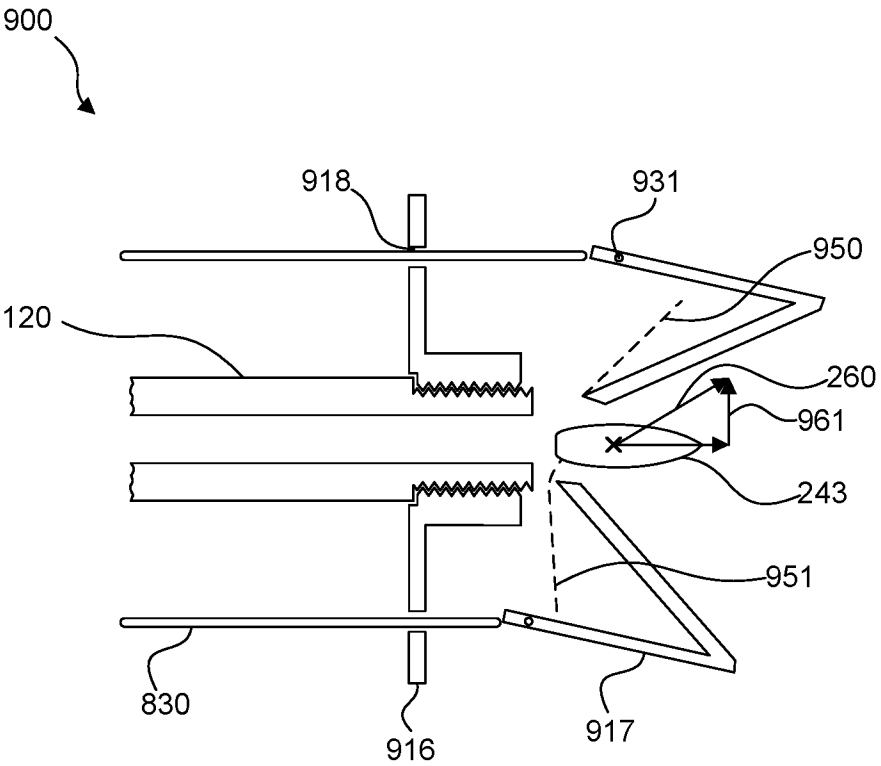
FIG. 9 shows a longitudinal cross sectional view of a muzzle device according to an embodiment.

A muzzle device 900 according to an embodiment having a baffle cone body 917 is shown in FIG. 9. Similar to the embodiment of FIG. 8, multiple push rods 830 are connected to a gas piston block on one end. The push rods 830 push and actuate a baffle cone body 917, to which they are attached via bearings 931. Push rods 830 are guided by guide bushings 918 that pass through a guide plate 916. The linear actuation of the push rods 830 gimbals the baffle cone body 917 so that it is canted as shown. This cant, in combination with the high-speed high-pressure gas exiting the barrel 120, leads to an aerodynamic force 260 on the bullet 243, such that the force 260 may have a radial component 961 that alters the trajectory of the bullet 243. The aerodynamic force 260 may arise, for example, due to the gas flow leading to an attached shock 950 on one side of the baffle cone body 917, versus a detached shock 951 on an opposing side of the baffle cone body 917, such as is understood by those knowledgeable in the gas dynamics leading to attached and detached shock formation in the flow of supersonic gas past cones and wedges.

Figure 10:
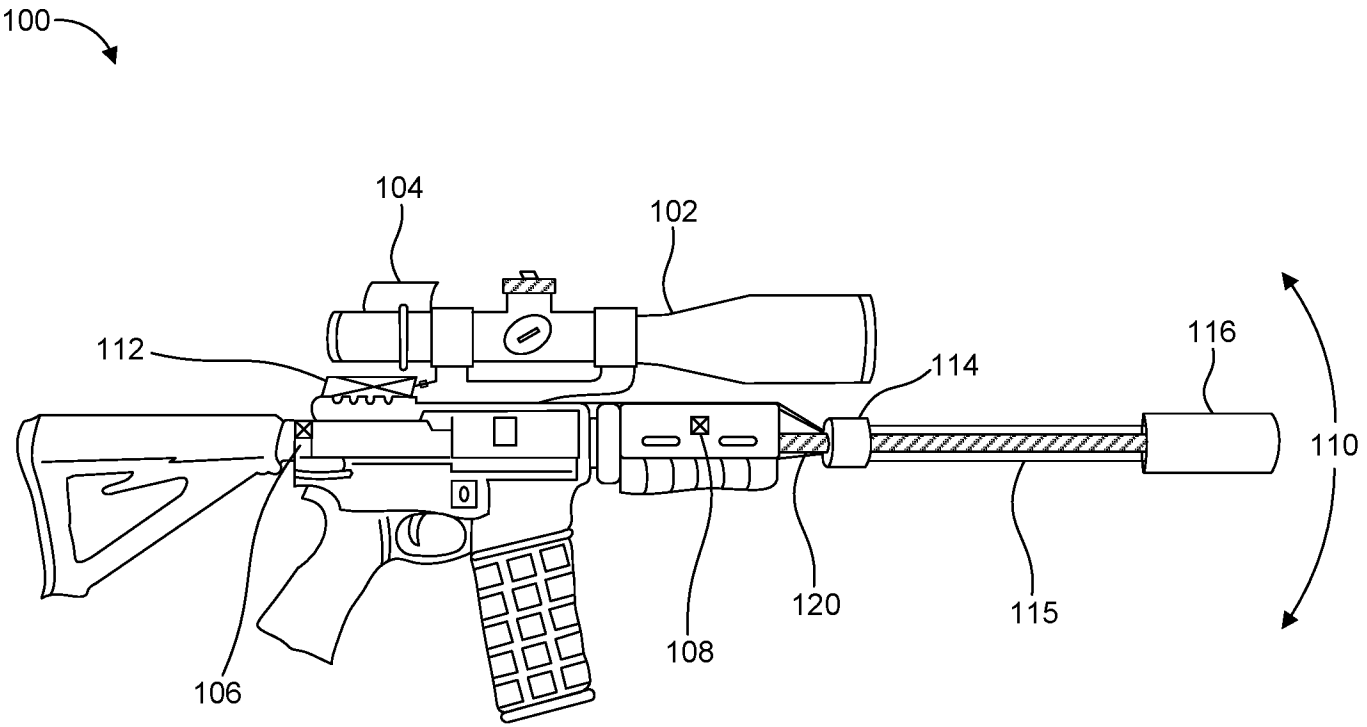
FIG. 10 shows a view of a firearm having an aim-stabilization system according to an embodiment.

An embodiment of a firearm 100 having a muzzle device 116 and a gas block multiplexer 114 according to an embodiment is shown in FIG. 10. The firearm 100 as shown is based on the popular AR-15 platform, however, it is understood that any firearms may be used including semi-automatic rifles, bolt-action rifles, as well as larger guns, up to and including a cannon. Similar to the embodiment of, for example, FIG. 1, the firearm 100 may include an electrically-powered electronic microprocessor control unit 112 that receives input from an optical sensor 104 attached to a riflescope 102, and/or from inertial sensors 106 and 108 placed on firearm 100. Inertial sensors 106 and 108, and/or optical sensor 104, can detect rotation of the weapon such as changes in elevation 110, changes in azimuth, and cant, the latter being rotation of the weapon around the axis passing axially through (coincident and parallel) to the barrel 120.

Figure 11:
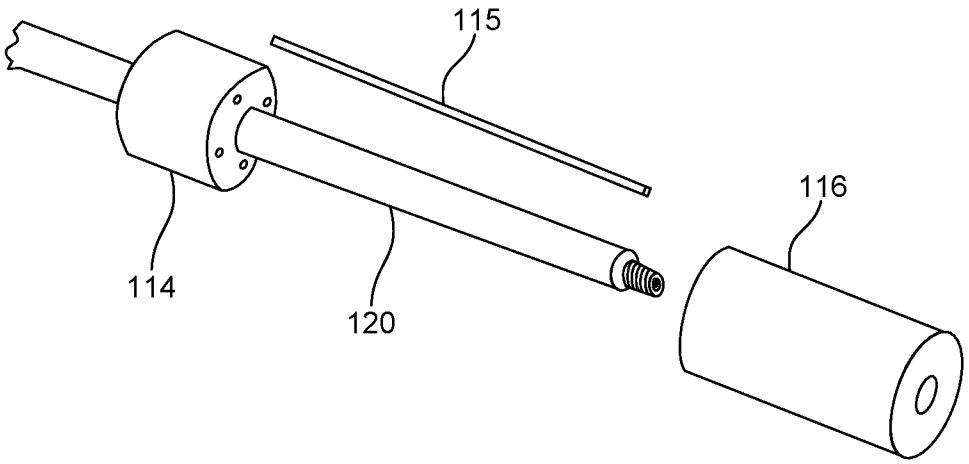
FIG. 11 shows a view of components of the firearm and aim-stabilization system according to the embodiment of FIG. 10.

The control unit 112 of firearm 100 conveys voltages and currents via wire to a gas block multiplexer 114. Gas block multiplexer 114 receives high-pressure gas from barrel 120 through a gas port or ports drilled in barrel as is understood by those practiced in the art. Gas block multiplexer 114 distributes gas pressure and flow into a plurality of gas tubes 115 in proportion to signals received from control unit 112. In some embodiments, there may be three or more, or four or more gas tubes 115. Gas tubes 115 convey high-pressure gas to aim-compensating muzzle device 116. The muzzle device 116 may be threaded as shown in FIG. 11.

Figure 12A:
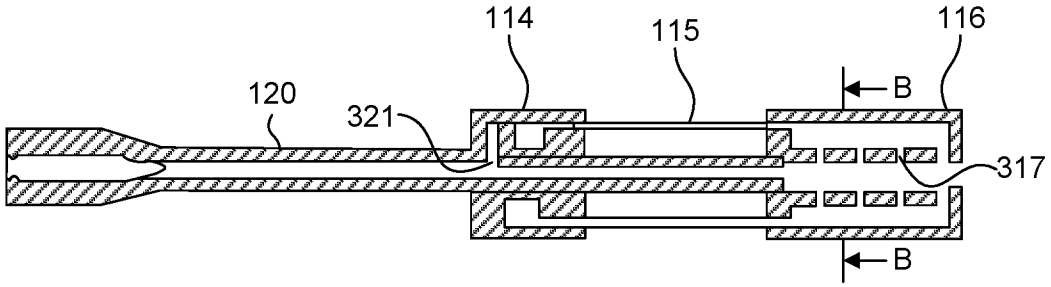
FIGS. 12A and 12B show a longitudinal and transverse cross sectional views, respectively, of a portion of a firearm including a muzzle device.
Figure 12B:
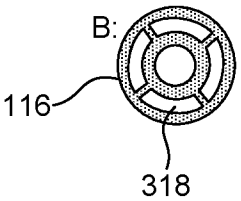

FIGS. 12A and 12B show cross sectional views of a barrel and muzzle device, including a longitudinal cross section, showing barrel 120, gas port 321, gas block multiplexer 114, gas tubes 115, and aim-compensating muzzle device 116, with array of gas nozzles 317. Also shown is a transverse cross-section of aim-compensating muzzle device 116 showing four internal gas chambers 318.

In some embodiments, barrel 120 may include two or more gas ports 321 configured to supply gas to multiple chambers of gas block multiplexer 114. Each port 321 may be positioned radially on barrel 120, and may be spaced about a circumference of barrel 120. Each chamber of gas block multiplexer may supply gas via a gas tube 115 to a different chamber 318 of muzzle device 116.

Figure 13:
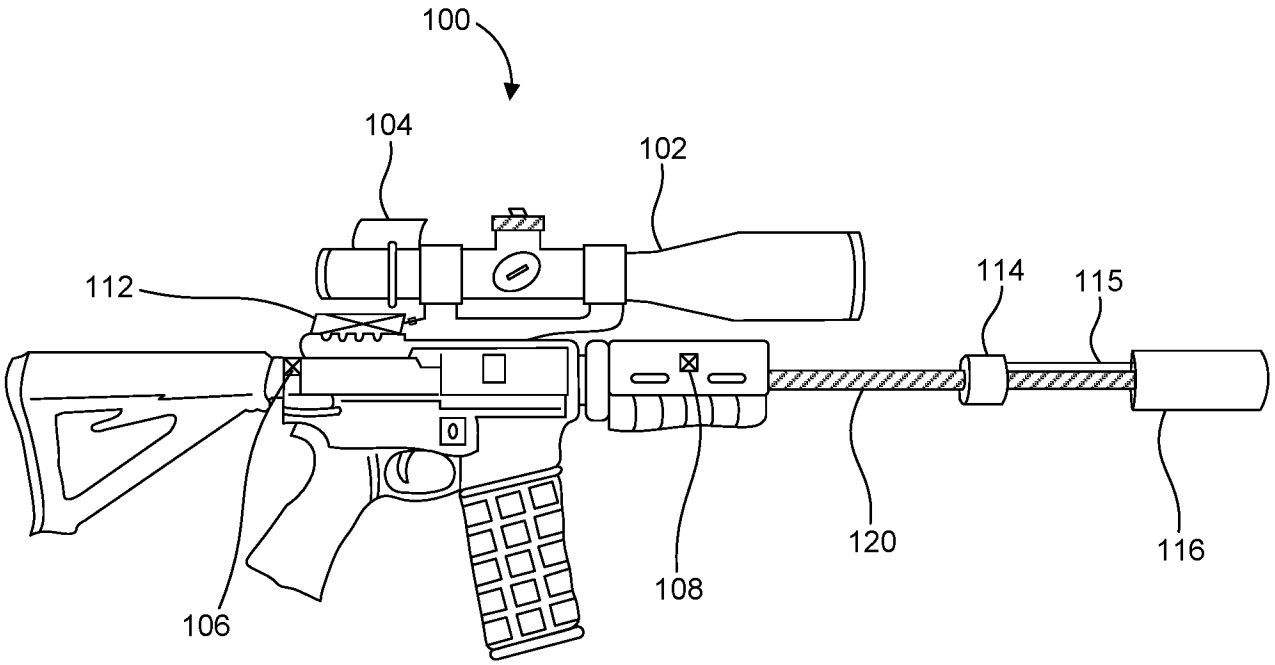
FIG. 13 shows a firearm having an aim-stabilization system according to an embodiment.

FIG. 13 shows an embodiment of firearm 100 that is similar to the firearm of FIG. 10, but in which the gas block 114 is not a multiplexer and includes only one gas tube 115 which passes from the gas block 114 to the aim-compensating muzzle device 116. In this embodiment, the gas tube 115 feeds gas into a single main internal chamber in aim-compensating muzzle device 116, and internal valves and/or control surfaces modulate the flow of this gas through nozzles internal to the aim-compensating muzzle device 116.

Figure 14:
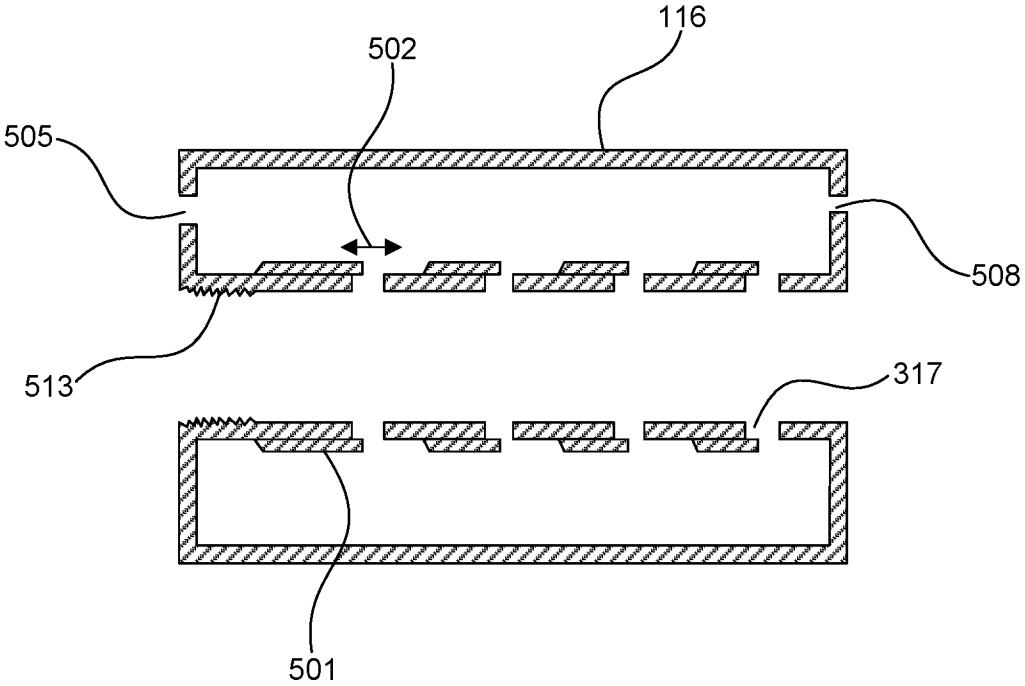
FIG. 14 shows a muzzle device according to the embodiment of FIG. 13.

FIG. 14 shows the internal structure of an embodiment of the aim compensating muzzle device 116 corresponding to the embodiment shown in FIG. 13, as seen in longitudinal cross section with threads 513 for attachment of muzzle device 116 to barrel 120. Gas enters muzzle device 116 through a gas tube 115 inserted into gas inlet 505. Flow of high-pressure gas into nozzles 317 is modulated by electromechanical restrictors or valves 501 that modulate flow through nozzles 317 by some type of motion 502 such as by piezoelectric effect or simple electrical motor effect or some other motor effect. Gas overpressure may be relieved through overpressure port 508 that may also be modulated by motorized valve, restrictor, or other actuator.

Figure 15:
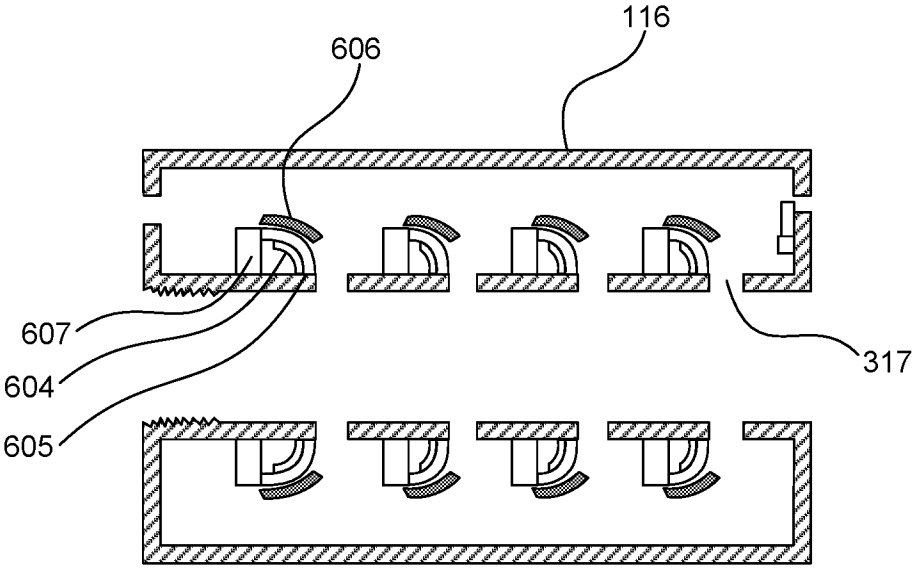
FIG. 15 shows a muzzle device according to an embodiment.

FIG. 15 shows the internal structure of another embodiment of the aim-compensating muzzle device 116 corresponding to the embodiment shown in FIG. 13, as seen in longitudinal cross section. Flow of high-pressure gas into nozzles 317 is modulated by control surfaces such as virtual control surfaces consisting of dielectric barrier discharge (DBD) plasmas 606 created by an exposed electrode or electrodes 607 and/or an electrode 604 shielded by dielectric material 605.

Figure 16:
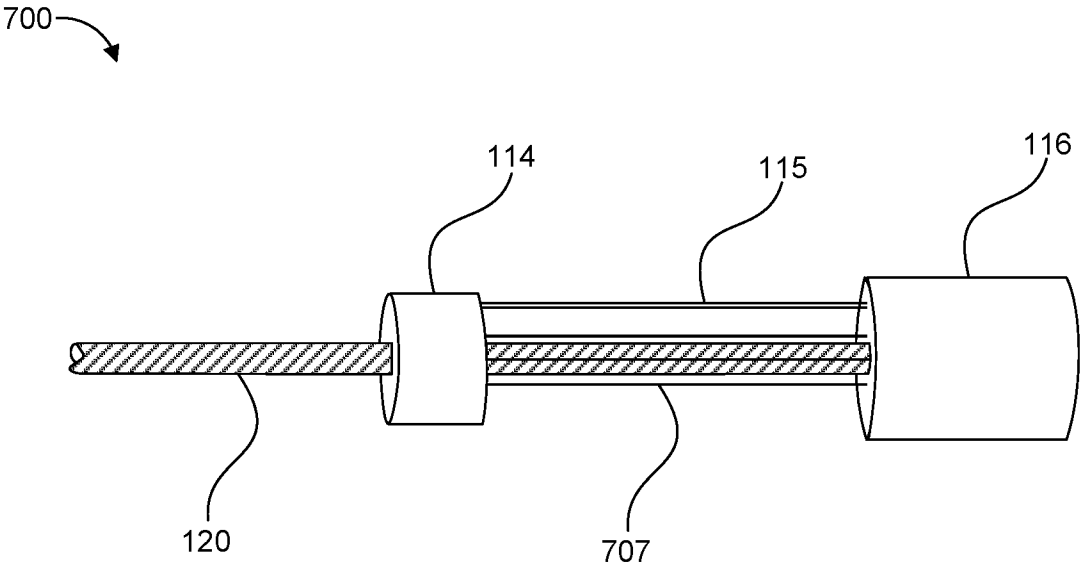
FIG. 16 shows a portion of a firearm and muzzle device.

FIG. 16 illustrates an embodiment in which, attached to the barrel 120 and receiving gas through a gas port, gas block 114 includes hydraulically-actuated push-rods 707, actuated by hydrostatic pressure of exhaust gases and modulated by electronically-controlled modulators internal to gas block 114. Gas is conveyed to muzzle device 116 through a gas tube 115, and internal to muzzle device 116 are valves actuated by push-rods 707 to modulate flow through internal nozzles (similar to nozzles 317 in FIG. 12A) via valves or modulators similar to valves 501 in FIG. 14.

Figure 17:
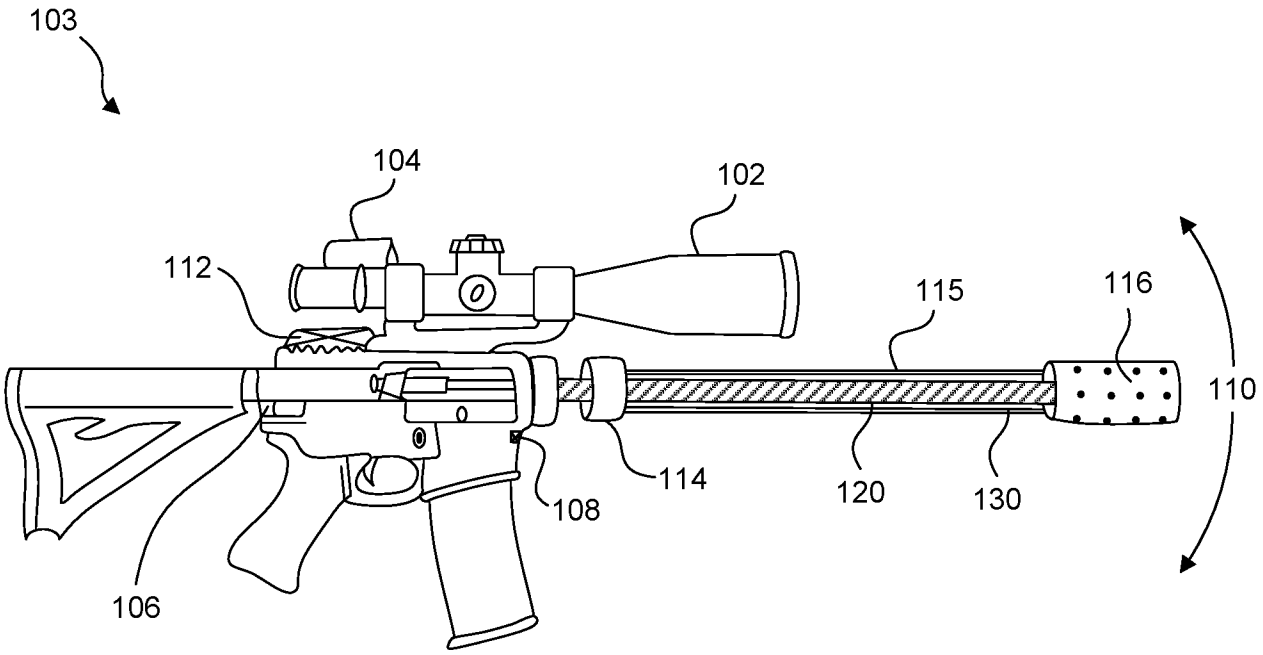
FIG. 17 shows a view of a firearm having an aim-stabilization system according to an embodiment.

Some embodiments described herein relate to a firearm 103 having a muzzle device 116 for directing gas outwardly from the muzzle device 116 so as to adjust the positioning of the barrel of the firearm 103, as shown for example by FIG. 17. Thus, in contrast to firearm of FIG. 1, gas is directed outwardly from the muzzle device 116 such that a position of barrel is adjusted in order to alter a trajectory of a projectile. The firearm 103 as shown is based on the AR-15 platform, but it is understood that the firearm may be any firearm, such as bolt-action rifles, as well again as larger guns, up to and including cannon. As discussed above, such as with respect to the embodiment of FIG. 1, a control unit 112 conveys voltages and currents via wire 130 to aim-compensating thrust-vectoring muzzle device 116 based on data and information received by sensors 104, 106, 108 arranged on firearm 103. A gas block 114 receives high-pressure gas from barrel 120 through a gas port or ports drilled in barrel 120 as is understood by those practiced in the art. Gas block 114 conveys gas into gas tube 115. Gas tube 115 conveys high-pressure gas to aim-compensating thrust-vectoring muzzle device 116.

Figure 18:
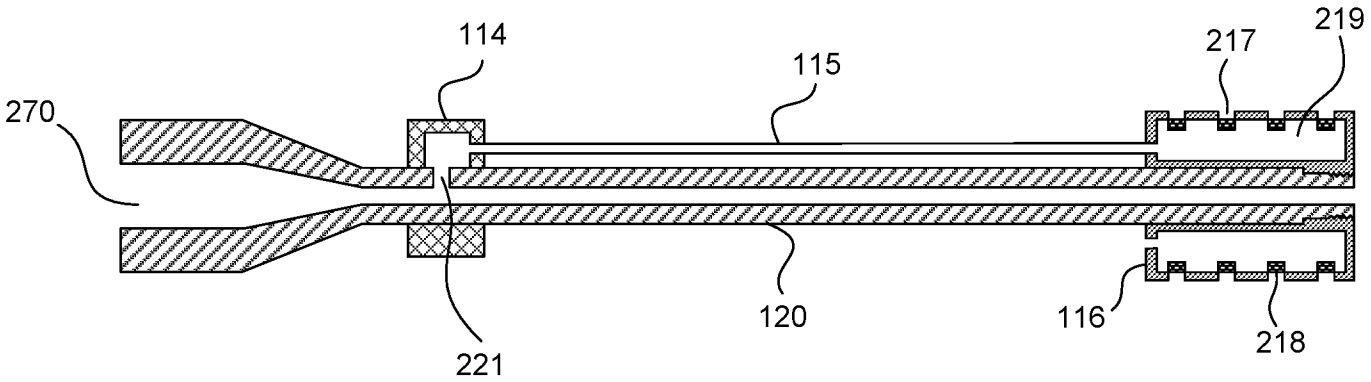
FIG. 18 shows a longitudinal cross sectional view of a portion of the firearm according to FIG. 17.

FIG. 18 shows a longitudinal cross sectional view a muzzle device 116 and barrel 120 of the firearm of FIG. 17 having a gun chamber 270, gas port 221, gas block 114, gas tube 115, and an aim-compensating thrust-vectoring muzzle device 116. Muzzle device 116 includes a muzzle device chamber 219, and arrays of gas nozzles or orifices 217, each having a valve or restrictor 218. Gas port 221 and gas block 114 may be placed much closer to gun chamber 270 than is typical for design of a semi-automatic weapon. In another embodiment, gas port 221 may actually be located at the distal end of the gun chamber 270 itself, rather than being located in the nominal, rifled section of barrel 120.

Figure 19A:
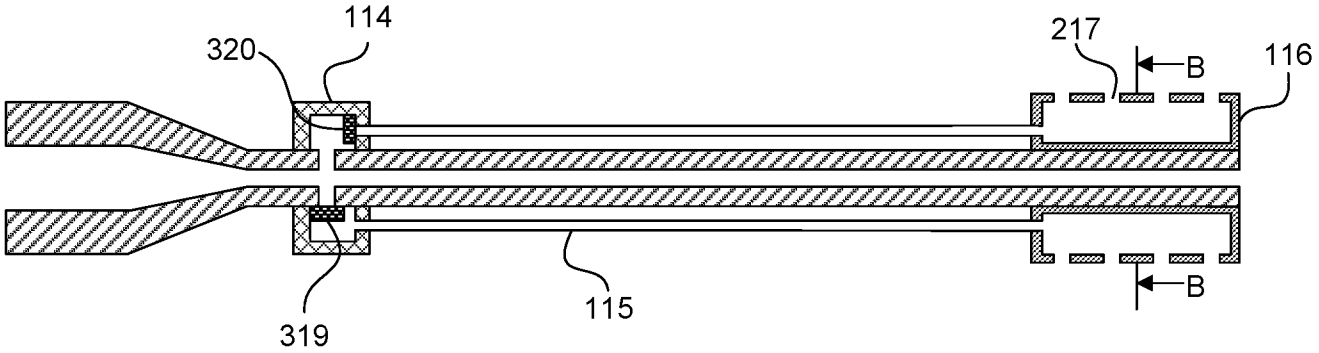
FIGS. 19A and 19B show longitudinal and transverse cross sectional views, respectively, of a portion of a firearm according to an embodiment.
Figure 19B:
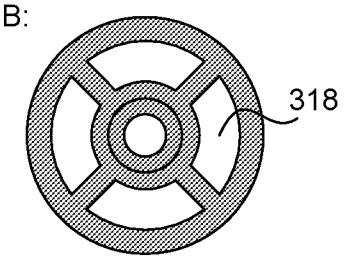

FIGS. 19A and 19B show cross sectional views of another embodiment, one being a longitudinal cross section and the other being a cross-section of the muzzle device taken at a plane located as marked "B" in FIG. 19A. In this embodiment, the gas block is a gas block multiplexer 114 having a plurality of exit ports each with a valve or restrictor 320, and/or the gas block multiplexer 114 has multiple internal chambers and there are multiple gas ports in the barrel, each with its own valve or restrictor 319. Multiple gas tubes 115 convey high-pressure gas from the gas block multiplexer 114 to the aim-compensating thrust-vectoring muzzle device 116. The aim-compensating thrust-vectoring muzzle device 116 again has multiple orifices or nozzles 217, and a plurality of internal chambers 318 (e.g., four chambers), each chamber being fed gas through a distinct and separate gas tube 115.

Figure 20:
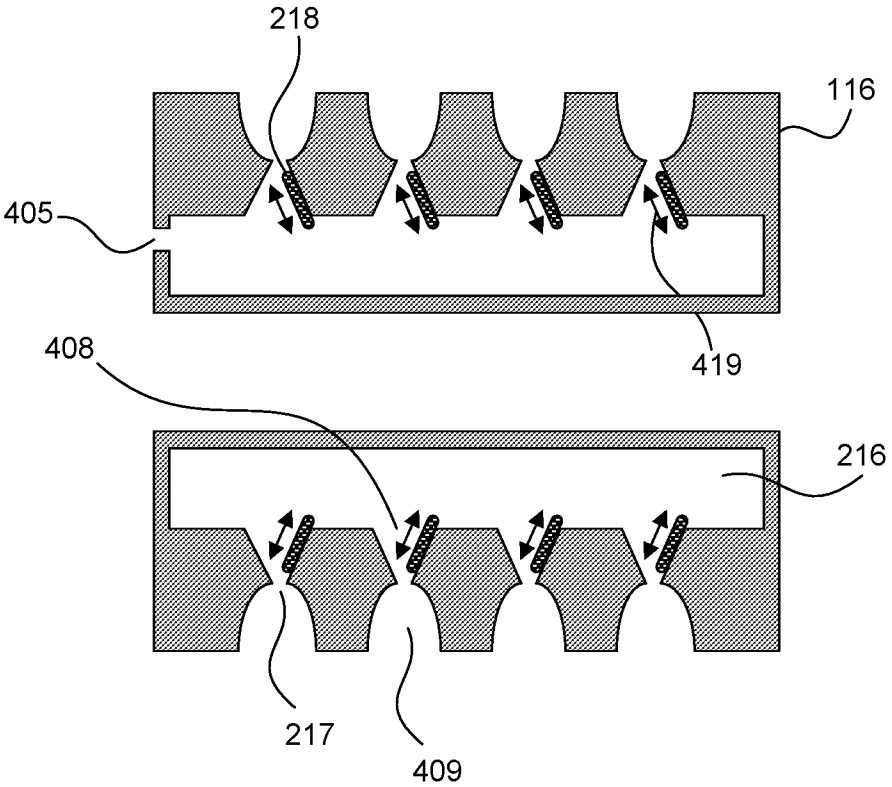
FIG. 20 shows a longitudinal cross sectional view of a muzzle device according to an embodiment.

FIG. 20 shows a longitudinal cross section of another embodiment of the aim-compensating thrust-vectoring muzzle device, this embodiment receiving high-pressure gas from a single gas tube. Included are an input port 405 where gas is conveyed from a gas tube to muzzle device chamber 216, and multiple gas orifices or nozzles 217 (e.g., sixteen), which in this case are de Laval (convergent-divergent) nozzles, each with a convergent section 408 and a divergent section 409. Each nozzle has a valve 218 or restrictor or other modulator actuated by small microelectronic actuator such as a servomechanism or piezoelectric actuator or other actuator, resulting in motion 419 or other method to open or close or in any case modulate the flow of gas through the nozzle, such as at the throat of the nozzle 217.

Figure 21:
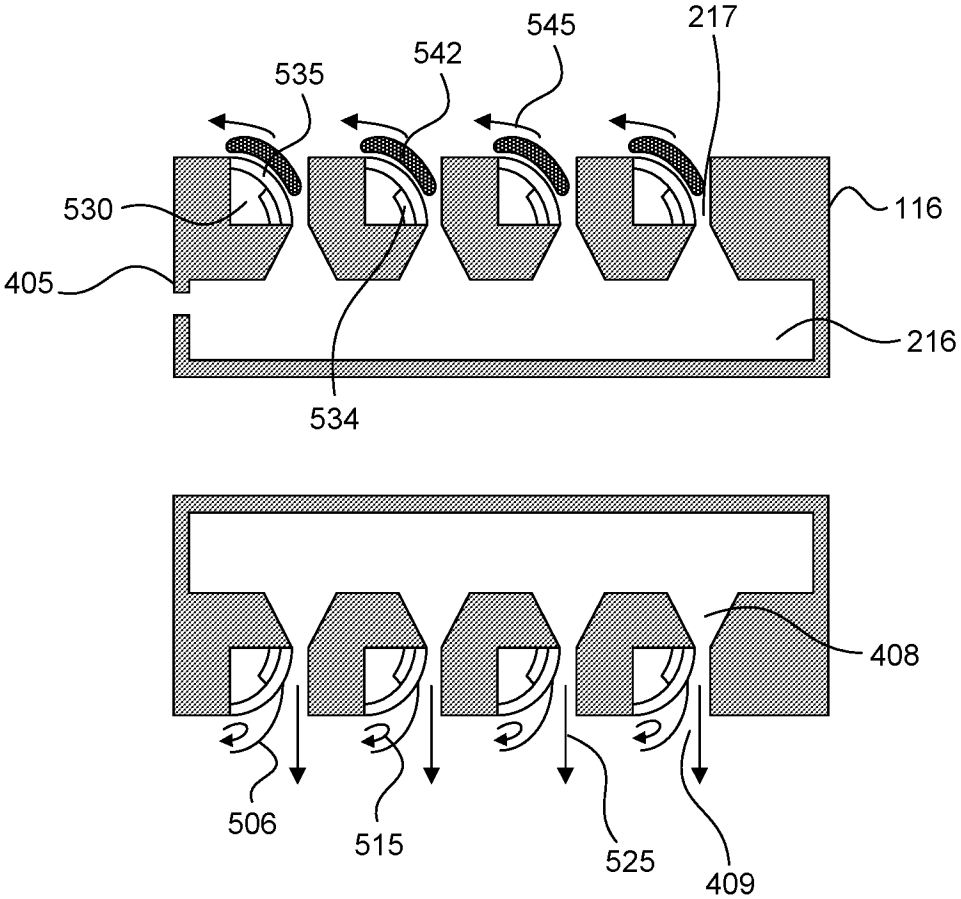
FIG. 21 shows a longitudinal cross sectional view of a muzzle device according to an embodiment.

FIG. 21 shows a longitudinal cross section of another embodiment of the aim-compensating thrust-vectoring muzzle device 116, this embodiment again receiving high-pressure gas from a gas tube through an input port 405, here into a muzzle device chamber 216 leading to multiple nozzles 217, each with a convergent section 408 and divergent section 409. The divergent section 409 is configured such that, in the absence of the action of a control surface or control mechanism, when high-pressure gas exits the nozzle 217, the flow creates boundary-layer separation 506, with a recirculation zone 515, leading to gas flow that is substantially predominantly radial, 525, as is understood by those practiced in the art of designing supersonic divergent nozzles. Placed in or near the divergent section of each nozzle is a control surface, in this case being a dielectric-barrier discharge (DBD) plasma virtual control surface, consisting of an insulator 530, a first electrode (here being the body of the muzzle device 116), a second electrode 534, and a dielectric 535, such that when a suitable voltage and current is supplied to the electrodes, a DBD plasma virtual control surface 542 is created. When the control surface or DBD plasma virtual control surface is actuated or activated, nominally radial flow 525 is re-directed to be substantially axial in direction, 545. This leads to thrust vectoring, i.e. the control surface allows the resultant thrust from each nozzle 217 to be modulated in direction and/or magnitude.

Figure 22:
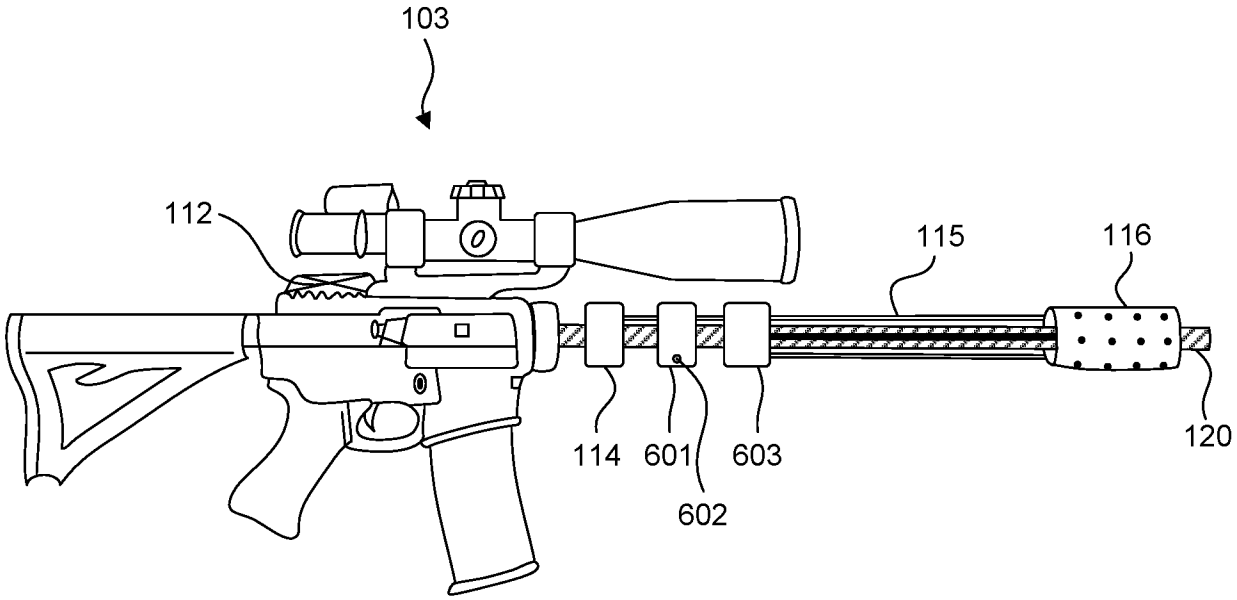
FIG. 22 shows a view of a firearm having an aim-stabilization system according to an embodiment.

In some embodiments, a firearm 103 may further include a gas filter block 601, as shown for example in FIG. 22. Firearm 103 includes a gas block 114 that receives gas from barrel 120 through gas port and conveys this gas via a gas tube to gas filter block 601. Gas filter block 601 contains a device to filter particulate residue from high-pressure gas, such a device may include a simple frit or sieve, or a centrifugal filter, or a plasma-based filter, and may include an exit port 602 for particulate-laden gas. Gas filter block 601 conveys gas via a gas tube to gas multiplexer 603, which, in response to electrical signals received from control unit 112, modulates gas pressure and/or flow directed into multiple gas tubes 115 that convey gas to aim-compensating thrust-vectoring muzzle device 116. In this embodiment, muzzle device 116 is not affixed to the barrel 120 directly on the muzzle itself, but rather simply near the muzzle, with the barrel 120 extending some distance beyond the muzzle device 116.

Figure 23:
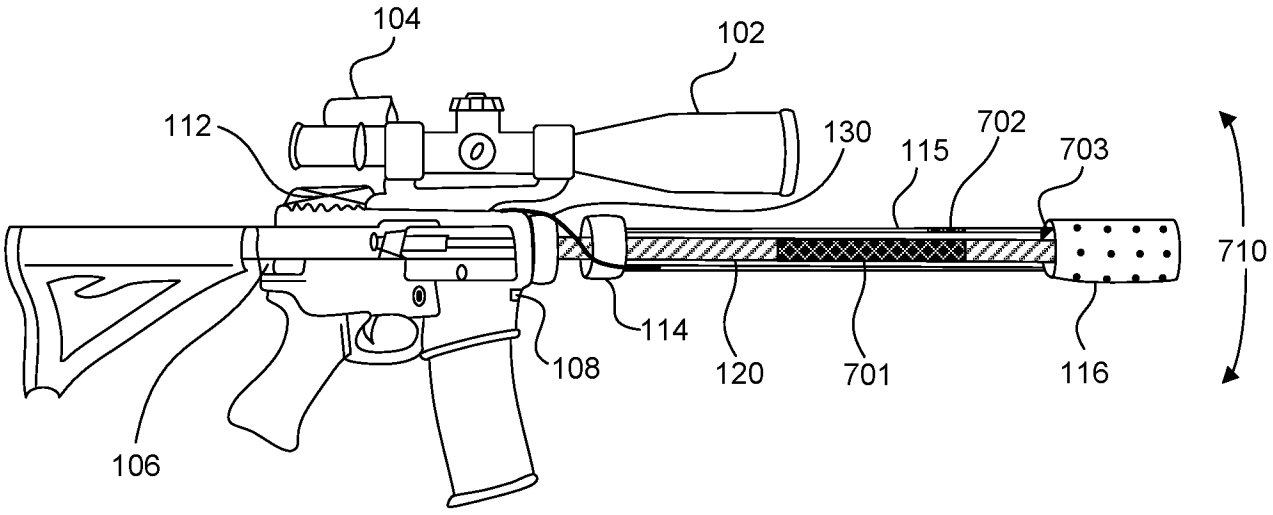
FIG. 23 shows a view of a firearm having an aim-stabilization system according to an embodiment.

In some embodiments, firearm 103 may further include a flexible barrel or a barrel with a flexible section or coupler as shown in FIG. 23. Barrel 120 is flexible and/or contains a section of flexible material 701 such that the pointing of the muzzle can be affected, such as the elevation 710, as well as the azimuth (in and out of plane of page). Elevation 710 is distinct from the pointing as indicated in, e.g., FIG. 17, as elevation 110 in FIG. 17 indicates the elevation of the entire barrel or weapon, whereas elevation 710 indicates only the elevation of the distal part of the barrel, and the muzzle in particular, which may not be the same as the pointing of the proximal part of the barrel, close to and including the chamber. Flexible material 701 also allows, again, flexure in azimuth as well as elevation 710. Gas tube 115 includes a section 702 that is flexible and/or allows linear motion, and gas tube connection to muzzle device 116 and/or gas block 114 is via coupler or couplers 703 that allow linear motion so as not to impede flexure of flexible material 701.

Figure 24:
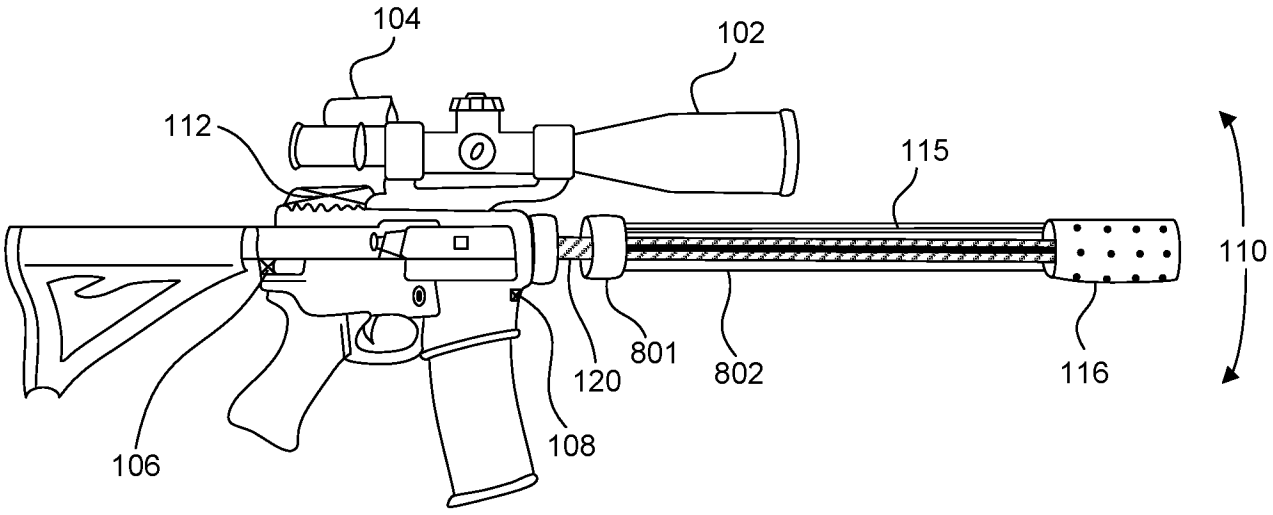
FIG. 24 shows a view of a firearm having an aim-stabilization system according to an embodiment.

In some embodiments, firearm may include a gas block with an internal system of hydraulically-activated pistons that push push-rods which in turn operate valves or modulators internal to muzzle device, as shown in FIG. 24. Gas tube 115 conveys gas from gas block and actuator 801 to muzzle device 116. Push rods 802 convey force and/or motion such as linear force and/or motion from gas block and actuator 801 to muzzle device 116. Muzzle device 116 includes nozzles or orifices for passage of gas supplied by gas tube 115 and modulated by valve, restrictors, or control surfaces operated by push-rods 802.

Figure 25:
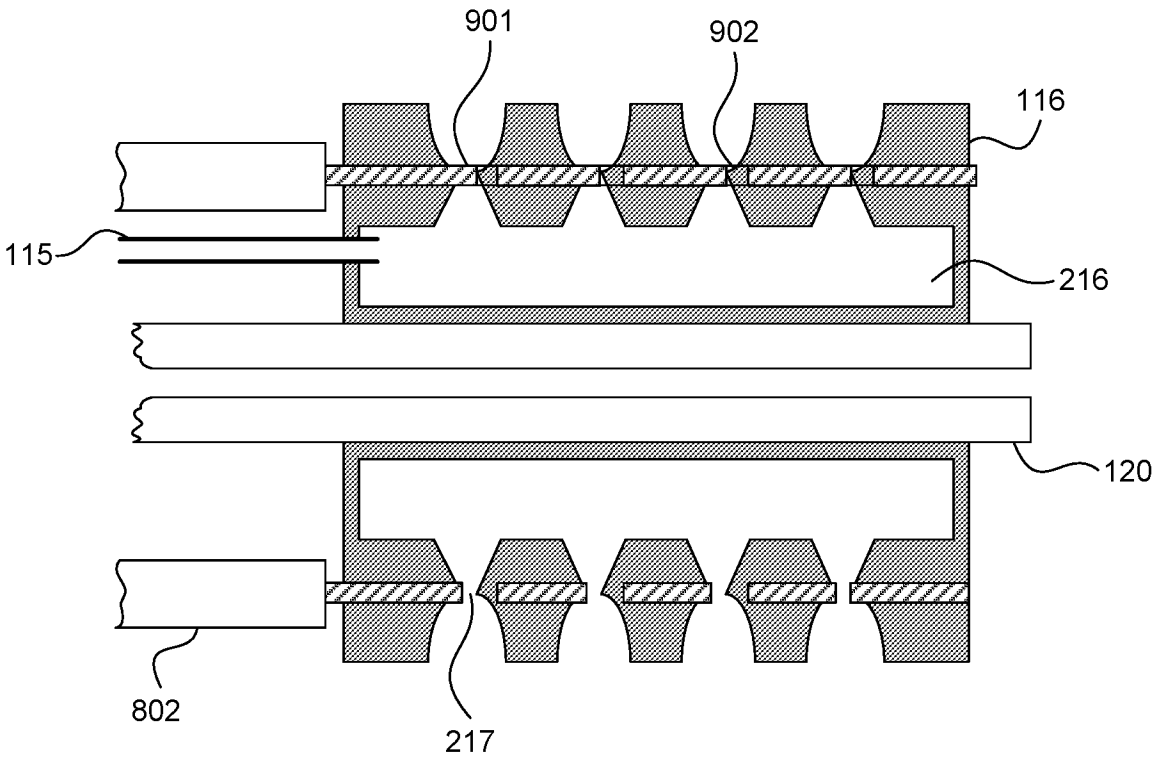
FIG. 25 shows a longitudinal cross sectional view of a muzzle device according to an embodiment.
Figure 26:
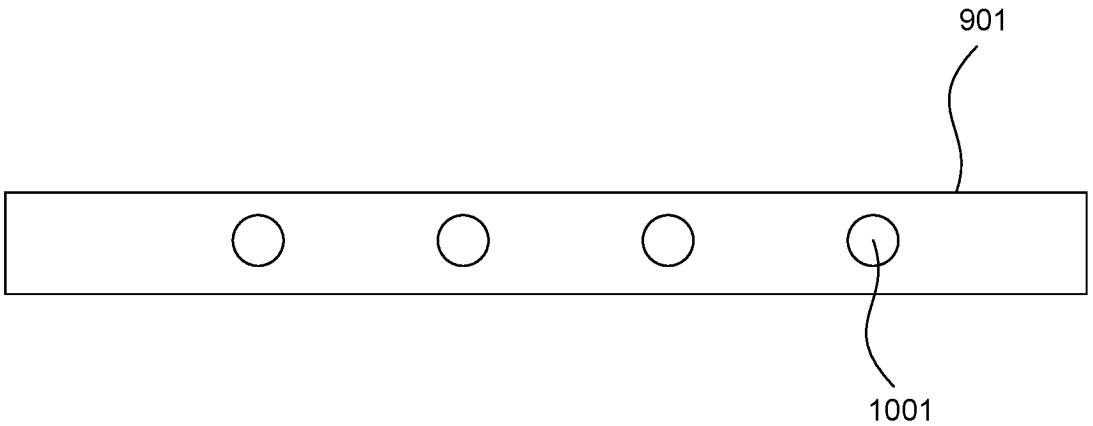
FIG. 26 shows a plan view of a gate valve plate according to the embodiment of FIG. 25.

FIG. 25 shows a longitudinal section of a detail of an embodiment corresponding to the full embodiment as shown in FIG. 24 in which muzzle device 116, mounted on barrel 120, is fed gas from gas tube 115 into main chamber 216, leading to multiple exit nozzles or orifices 217, the flow through which is opened or closed or otherwise modulated by the force and/or motion of push rods 802. In this embodiment, push rods 802 linearly actuate gate valve plate 901, which slides forward and backwards in a channel 902 in muzzle device 116, and in so doing opening, closing, or otherwise modulating the flow of high-pressure gas from chamber 216 through nozzles or orifices 217. Gate valve plate 901 may include an orifice or an array of orifices 1001 to aid in modulating flow of gas, as shown for example at FIG. 26. In another embodiment, push-rods 802 actuate control surfaces such as vanes or flaps which redirect the flow of gas through nozzles or orifices 217 and thereby accomplish thrust vectoring as is understood by those practiced in the art of thrust vectoring from nozzles.

Figure 27:
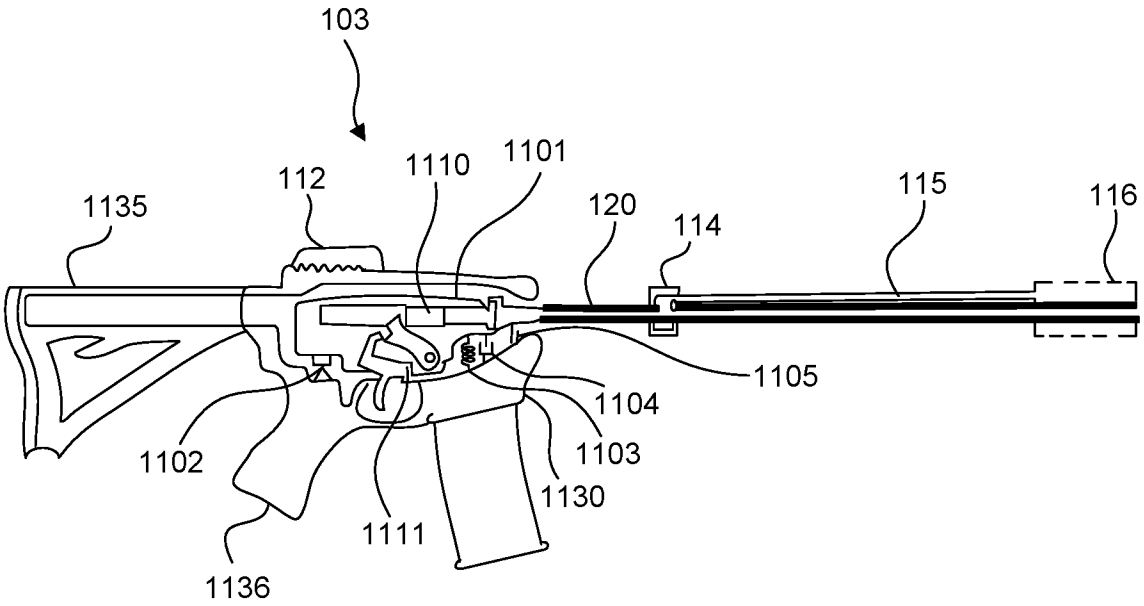
FIG. 27 shows a longitudinal cross sectional view of a firearm having an aim-stabilization system according to an embodiment.

FIG. 27 shows a longitudinal cross-section of an embodiment in which there is a carriage 1101. The carriage 1101 is attached to the main body 1130 of the firearm 103 in such a manner as to allow relative motion, the main body 1130 including the stock 1135, grip 1136, forearm, and/or other means of holding the firearm by the operator. Affixed to the carriage 1101 is the barrel 120, and possibly also the bolt or bolt carrier group 1100 and the fire control unit 1111 and other components of the action. In another embodiment, the carriage 1101 and the barrel 120 are one and the same. The carriage 1101 is attached to the main body 1130 at one or more hinges, flexures or contact points 1102. In addition, main body 1130 and carriage 1101 may be connected by one or more springs 1103 and/or dashpots 1104. One or more digital encoders 1105 or other sensors may sense relative motion between main body 1130 and carriage 1101, and transmit this information, either by wire or wirelessly, to control unit 112. Control unit 112 may receive information regarding the orientation of the main body 1130 and/or carriage 1101 by inertial sensor or sensors, as discussed in other embodiments above. Control unit 112 may also receive information regarding the orientation of the main body 1130 and/or the carriage 1101 by way of an optical sensor or sensors as discussed above regarding other embodiments, and as may receive optical transmission from optical device such as optical scope as discussed previously.

Figure 29:
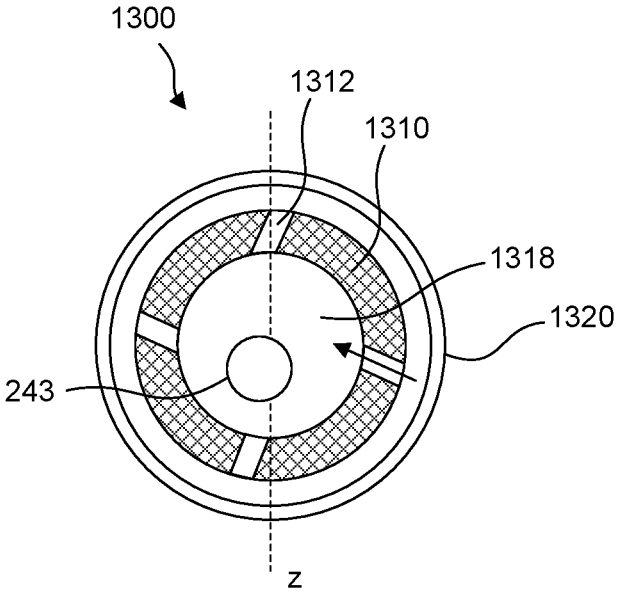
FIG. 29 shows a front view of a muzzle device having angled orifices.

In some embodiments as described herein, the muzzle device 116 may include an inner cylinder 1310 and an outer cylinder 1320, wherein the inner cylinder 1310 includes one or more rows of orifices 1312. In some embodiments, the orifices are arranged radially such that gas dynamic forces are exerted laterally on the projectile. However, in some embodiments as shown for example at FIG. 29, the orifices 1312 may be arranged at an angle relative to a transverse or radial axis Z of the muzzle device 116 so as to cause gas to enter chamber 1318 with a substantially tangential (i.e., azimuthal) motion, so as to induce radial gas-dynamic forces upon projectile 243 due to the effects described below. As a result of the angled orifices 1312, the tangential flow may cause a difference in airflow or pressure on the projectile 243, capable of altering the trajectory of the projectile, such as via the Bernoulli effect, the Coanda effect, or some combination thereof. The orifices 1312 may be selectively opened, closed, or partially closed via control surfaces, such as gates, valves, and the like as described herein.

Figure 30:
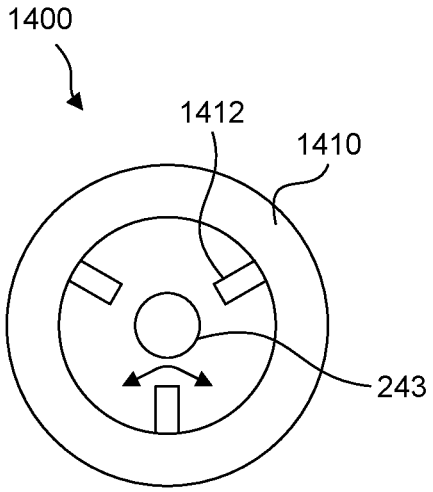
FIG. 30 shows a front view of a muzzle device having adjustable vanes.

Further, in some embodiments, the muzzle device 116 may include one or more vanes 1412 directed inward from the inner cylinder 1410, as shown in FIG. 30, so as to alter the aerodynamic forces exerted by the gas flowing therethrough. The vanes may be pivotally positioned so as to tilt to as to cause gas to swirl or spin. In some embodiments, the vanes may tilt up to about 30° relative to their initial position in which vanes extend radially inward from an inner surface of inner cylinder 1410. This may enhance the Bernoulli effect, so as to exert more pressure or flow on one side of the bullet.

It will be apparent to persons skilled in the relevant art that the elements and features of the present disclosure can be implemented in hardware using analog or digital circuits, in software, through execution of computer instructions by one or more general or special purpose processors, or as a combination of hardware and software.

Figure 34:
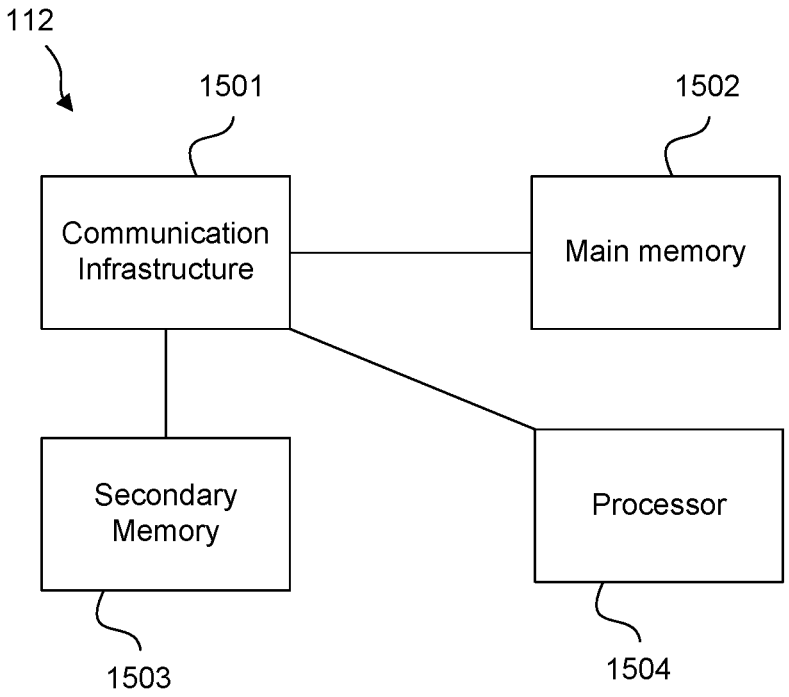
FIG. 34 shows a schematic diagram of a control unit of the aim compensation system according to an embodiment.

The following description of a general purpose computer system is provided. The control unit 112 as described herein can be implemented as one or more computer systems or processing systems. An example of such computer system is shown in FIG. 34. Control unit 112 may include one or more processors 1504, such as a general or special purpose digital signal processor. Processor 1504 may be connected to a communication infrastructure 1501, for example a bus, or network. Control unit 112 may include a main memory 1502, such as RAM, and may include a secondary memory 1503, such as a hard disk drive or a removable storage drive. Secondary memory 1503 may provide means for allowing computer programs or other instructions to be loaded into the control unit 112. Control unit 112 may further include a communication interface 1501 to allow software and data to be transferred from external devices. Computer programs may be stored in the main or secondary memory and may be received from a communication interface 1501. Such computer programs when executed enable the computer system to implement processes of the present disclosure, such as the methods for aim-stabilization as described herein.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventors, and thus, are not intended to limit the present invention(s) and the appended claims in any way.

The foregoing description of the specific embodiments will so fully reveal the general nature of the invention(s) that others can, by applying knowledge within the skill of the art, readily modify and/or adapt for various applications such specific embodiments, without undue experimentation, and without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance herein.

The breadth and scope of the present invention(s) should not be limited by any of the above-described exemplary embodiments, but should be defined only in accordance with the following claims and their equivalents.

The following examples are merely illustrative and should not be construed as limiting the scope of this disclosure in any way as many variations and equivalents will become apparent to those skilled in the art upon reading the present disclosure.

EXAMPLES

Example 1—Redirecting Bullet Via Muzzle Gas

For fiducial purposes, the calculations are based around the popular AR-15 rifle with a 20 inch barrel, firing a 5.56×45 mm NATO round with a standard 62-grain M855 bullet.

This is a Jupyter notebook. Jupyter is designed for sharing calculations especially in Python (but also other computer languages), not for generating polished reports; the notebook will of necessity include quite a lot of Python commands.

1.1 Imports

In [15]: from math import*

1.2 Units note: notebook uses cgs units (centimeter, gram, second)

In [16]: cm=1.0 mm=0.1# using cgs units inch=2.54 grain=0.065# mass of grain in grams bar=1.0e6# in cgs units atm=1.01*bar psi=atm/14.7 deg=pi/180.0# degrees, in radians

MOA=deg/60.0

1.3 Fiducial Quantities bullet:

In [17]: m_bullet=62*grain

In [18]: A_bullet_side=(17.0*mm)*(5.56* mm) # rough estimate of effective side-projected are of bullet #

In [19]: Pexit=1.0e4*psi # fiducial quantity for gas pressure in barrel at moment bullet exits muzzle Bullet Kinematics:

In [20]: v_bullet=950*1.0e2#950 m/s is an estimated baseline muzzle velocity

Assume that a muzzle device exerts a lateral force on the bullet over a distance of about 2 cm. (The muzzle device could be made longer, but past a certain point, increased length has marginal utility, since the gas pressure will drop precipitously.) Assume that the effective pressure difference from one lateral side to the other is about the same as the reference pressure of 10,000 psi, multiplied by some overall efficiency factor of, e.g., ⅓. The rationale is that the total dynamic pressure is greater than the reference pressure by some non-negligible factor, but the pressure will rapidly decrease as the bullet moves out of the barrel, and further the muzzle device will not be entirely effective in re-directing the axially-moving muzzle gases so as to create a lateral force.

In [21]: # what is F_perp, the force on the bullet perpendicular to its direction of travel?
efficiency_factor=⅓# estimated
F_perp=efficiency_factor*A_bullet_side*Pexit
In [22]: # what is the corresponding acceleration?
a_perp=F_perp/m_bullet
In [23]: # What is the duration of this lateral acceleration?
t=(2*cm)/v_bullet
In [24]: # What is the resultant velocity the bullet gains, perpendicular to its initial direction?#
v_perp=a_perp*t
In [25]: # What is the resultant angular deflection, in radians?
ang_defl=v_perp/v_bullet
In [26]: # What is the resultant angular deflection, in milliradians?
print (ang_defl*1000.0)=11.903762029500824
In [27]: # what is the resultant angular deflection, in MOA?
print (ang_defl/MOA)=40.922119477108836

The calculated trajectory deflection is about 12 milliradians or about 41 MOA. This is a rough calculation; and in reality, the actual attainable deflections might be larger or smaller, but the above calculations provide an estimate of the order-of-magnitude for what is possible in principle. This calculation shows that it is not unreasonable to expect that one could, by this method, create an angular deflection (or "correction") to the bullet trajectory that is large enough to be useful, when combined with a system that makes such corrections on timescales small enough to compensate for, e.g., the normal shakes and jitters that a rifleman has in holding aim on a target, which are typically much smaller, depending on circumstance (e.g. good rest, vs standing, vs standing after heavy exertion, etc.), as described elsewhere.

Example 2—Redirecting Bullet Via Barrel Gas

For fiducial purposes, the calculations are based around the popular AR-15 rifle with a 20 inch barrel, firing a 5.56×45 mm NATO round with a standard 62-grain M855 bullet. Shorter barrels are also considered, such as 12 inches or shorter, which while generally not legal for civilian rifles, are legal for military and law-enforcement use.

0.0.1 Imports
In [1]: from math import*
0.0.2 Units
note: notebook uses cgs units (centimeter, gram, second)
In [2]: cm=1.0
mm=0.1# using cgs units
inch=2.54
grain=0.065# mass of grain in grams
bar=1.0e6# in cgs units
atm=1.01*bar
psi=atm/14.7
Pa=10.0# Pa in cgs
MPa=1.0e6*Pa
kbar=1.0e3*bar
Newton=1.0e5
poundf=4.448*Newton
poundm=1.0e3/2.2# a kg is 2.2 lbs
deg=pi/180.0# degrees, in radians
MOA=deg/60.0

Fiducial Quantities
Bullet:
In [3]: m_bullet=62*grain
In [4]: A_bullet_side=(17.0*mm)*(5.56*mm) # rough estimate of effective side-projected area of bullet
Cartridge:
In [5]: V_case=1.78# volume of case; about 1.78 cm^3
In [6]: m_powder=24.0*grain # mass of gunpowder
Barrel:
In [7]: A_barrel=(5.7*mm)**2*pi/4# cross-sectional area of bore
In [8]: V_barrel=A_barrel*(19*inch) # total volume of bore with 20-inch barrel
Pressures:
In [9]: Pmax=62366.0*psi # maximum chamber pressure
In [10]: Pexit=1.0e4*psi # good fiducial quantity for gas pressure in barrel at moment bullet exits muzzle, for 20" bbl
Bullet Kinematics:
In [11]: v_bullet=950*1.0e2#950 m/s is a good baseline muzzle velocity For an AR-15 rifle having a 20" bbl, the pressure at the muzzle when the bullet exits the barrel is about 10,000 psi, and for a 12" bbl, it is about 20,000 psi. The pressure when the bullet passes the gas port is higher, but it will drop by the time the bullet reaches the muzzle.

To determine the density of the barrel gas, the total volume available is needed; the gas system adds negligibly to this, so the total volume is the volume of the case and the barrel:

In [12]: V_tot=V_case+V_barrel # total volume
In [13]: rho_gas=m_powder/V_tot # assuming all of powder goes into gas;
print (rho_gas/1.225e-3) # Print ratio of barrel gas density to atmosphere;
nominal density of air is 1.225 kg/m^3=90.3503808247603
In [14]: # The sound speed of the propellant gases is about equal to the bullet muzzle velocity. Note that the muzzle velocity is about 95,000 cm/s.
c_s=sqrt(1.4*Pexit/rho_gas)
print (c_s)=93225.13035183627
print (c_s/v_bullet)=0.9813171615982765

Given a small orifice directing gas laterally at the bullet, gas will exit the orifice at Mach 1, at a certain total pressure equal to the sum of the static and dynamic pressures. In order to check these values; for example, the dynamic pressure will be of order p times the sound speed $c_s$, each multiplied by a small correction factor to account for the adiabatic expansion and cooling in accelerating the gas to sound speed. However, in the end the pressure 10,000 psi is recovered, which was inserted by assumption above.

To exert a lateral force on the bullet, however, in this system, it is not practical to have a large orifice of total area comparable to the area A_bullet_side that the bullet presents as viewed from the side. The quantity of gas supplied through the gas system is not sufficient for this purpose.

What is practical, however, is to have a small hole or holes that feed nozzles directing gas to hit the bullet laterally. Suppose that these nozzles are small de Laval nozzles, which we can examine using perfect gas theory. Assume the ratio of specific heats is γ=1.4. Then the density behaves as:

$$\frac{p}{p_0} = \left(1 + \frac{\gamma - 1}{2} M^2\right)^{-1/(\gamma-1)}$$

and the gas speed u behaves as:

$$\left(\frac{u}{c_s^*}\right)^2 = \frac{(\gamma+1)M^2}{2+(\gamma-1)M^2}$$

where $c_s^*$ is the reservoir sound speed $c_s^0$ corrected for adiabatic expansion:

$$\left(\frac{c_{s*}}{c_s^0}\right)^2 = \frac{2}{\gamma+1}$$

In [15]: c_s_star=c_s*sqrt(2/(1.4+1)) # this is a very small correction

Assume the nozzle expands after being fed by a small hole, such that the nozzle expands the gas by a factor of 5, linearly, corresponding to an area ratio of 25. In isentropic flow, this leads to a Mach 5 flow. Then:

In [16]: M=5
gam=1.4
u=c_s_star*sqrt((gam+1)*M**2/(2+(gam−1)*M**2))
print (u/c_s_star)
2.23606797749979

In [17]: rho=rho_gas*(1+0.5*(gam−1)*M2)(−1/(gam−1))
print (rho/rho_gas)
0.011340230290662856

At high Mach, the static pressure is negligible, leaving just the dynamic pressure:

$P_{dyn}=\frac{1}{2}\rho u^2$

In [18]: Pdyn=0.5*rho*u**2
print (Pdyn/psi)=330.75671681099993

This is about 1/30 the static pressure in the gas feed system.

This high-Mach gas flow impinging on the side of the bullet will create a normal shock just above the bullet surface, but the resultant effective lateral force will be unchanged. This dynamic pressure is considerably lower than the static pressure in the barrel of about 10,000 psi; at least partially compensating for this, we can "blow" sideways on the bullet for a longer distance, e.g., 5 cm, than if we were just using the gases exiting directly from the muzzle.

The sideways "blowing" is fairly efficient, and accordingly:

In [19]: F_perp=A_bullet_side*Pdyn # the effective sideways force on the bullet

In [20]: # what is the lateral acceleration of the bullet?
a_perp=F_perp/m_bullet In [21]: # what is the duration of this acceleration?
t=(5*cm)/v_bullet In [22]: # What is the resultant velocity the bullet gains, perpendicular to its initial direction?
v_perp=a_perp*t In [23]: # What is the resultant angular deflection, in radians?
ang_defl=v_perp/v_bullet In [24]: # What is the resultant angular deflection, in milliradians?
print (ang_defl*1000.0)=2.9529369349328545

In [25]: # what is the resultant angular deflection, in MOA?
print (ang_defl/MOA)=10.151449412396998

While relatively small, these deflections are still large enough to be useful in redirecting a bullet.

It is necessary to determine whether enough gas can be supplied to "paint" the bullet with high-Mach barrel gas impinging on the bullet laterally over the full assumed distance of 5 cm.

Assuming that the gas flow is always "on" (or "open"), we have to direct gas sideways, across the notional cylinder describing the bullet trajectory. That cylinder has a diameter of 5.56 mm and a length of 50 mm, for a total side area of:

In [26]: A_cyl_side=5.56*mm*5*cm

In [27]: # Since we assumed an area ratio of 25, the total cross-sectional area of the gas
# feed orifices is:
A_feed=A_cyl_side/25.0

In [28]: # An AR gas tube has a nominal inner diameter of 0.120" for a cross-sectional area of:
A_tube_AR=(0.120*inch)**2*pi/4

In [29]: # What is the ratio of the cross-sectional area we need to # feed our system, to the nominal AR tube area?
print (A_feed/A_tube_AR)=1.5240000475178217

In [30]: # Also:
print (A_feed/A_barrel)=0.43577789281178847

A practical system requires a slightly larger gas tube than the standard AR gas tube, but it is within reason, and can be done without making the gas tube ID larger than the barrel ID.

A short barrel rifle (SBR) offers theoretical advantages here, simply because of the availability of higher gas pressures.

For example, we can consider a 12" barrel instead of a 20" barrel. This leads to a 2× increase in the static pressure of the barrel gas (and the gas system) at the moment the bullet leaves the muzzle. Without going through the full length of the bullet deflection calculations above, the resultant dynamic pressure is expected to be roughly 2× as well, leading to a 2× increase in the lateral force, which in turn leads to a 2× increase in the deflection:

As a result, approximately 6 milliradians, or 20 MOA, is possible given the assumptions outlined above.

Alternatively, we can take the higher pressures afforded us and use that to reduce demands on the gas tube gas supply. For example, we can keep a standard ID AR gas tube rather than using a larger gas tube.

The benefits compound when going to even shorter barrels, although at some point a shorter barrel ceases to become practical, due in part to the increased demands on the gas system in containing the higher pressures, not to mention the increased noise, loss of muzzle velocity, muzzle flash, etc.

These simple, preliminary calculations demonstrate that gases sourced from the barrel through a gas tube, such as employed in standard gas-operated automatic and semi-automatic rifles, can be re-purposed to redirect the bullet by way of nozzles pushing the bullet laterally after it exits the barrel. The deflections so obtained are potentially large enough to be useful in counter-acting the shaking that a marksman inevitably has in trying to hold point-of-aim, assuming that the system is paired with an electronic system to make real-time corrections to create the correct lateral force (direction and magnitude) to compensate for the shaking.

Example 3—Redirecting Bullet Via Barrel Thrust Vectoring

In [1]: from math import*
In[2]: mm=0.1# using cgs units
inch=2.54
grain=0.065# mass of grain in grams
bar=1.0e6# in cgs units
atm=1.01*bar
Pa=10.0# Pa in cgs
MPa=1.0e6*Pa
kbar=1.0e3*bar
Newton=1.0e5
poundf=4.448*Newton
poundm=1.0e3/2.2# a kg is 2.2 lb
deg=pi/180.0# degree, in radians
MOA=deg/60.0
5.56×45 NATO
In [3]: Vcase=1.78# in $cm^3$
In [4]: Abarrel=(5.7*mm)**2*3.1415926/4
In [5]: Vbarrel=Abarrel*20*inch
In [6] print(Vbarrel)=12.9629336339
In [7]: Mpowder=24*grain
In [8]: Pmax=62366.0*psi # maximum chamber pressure
In [9]: dtbarrel=1.1e-3# about 1.1 ms from primer strike to bullet exit How big of a hole (nozzle) can we make to thrust vector, without adversely affecting internal ballistics too much?

In [10]: Abarrel # cross-sectional area of barrel
Out[10]: 0.25517585893500006
In [12]: (0.093*inch)**2*pi/4# nominal cross-sectional area of normal gas port
Out[12]: 0.043825129867142584

Start with a normal gas port but move closer to breech, and assume the flow is choked at the muzzle thrust-vectoring device:

In [13]: rho_exit_max=Mpowder/(Vcase+4*inch*Abarrel)
In [14]: c_s=3.0e5# estimated
In[17]: F=c_s**2*rho_exit_max*0.04# using 0.04 $cm^2$ as area of nozzle
In [18]: F/poundf
Out[18]: 2887.5126028373784

Moment of inertia of gun: assume a 6 pound rifle with an OAL of 30 inches, and pivoting about its center of mass, and as a rod of uniform linear density In [19]: Mrifle=6*poundm
In [20]: Lrifle=30*inch
In [21]: Irifle=(1/12.)Lrifle2
In [22]: ang_accel=(F*Lrifle/2)/Irifle)
In [24]: ang_vel=ang_accel*0.2*dtbarrel # assume main part of force only lasts about 0.2 ms
In [25]: ang_defl=ang_vel*dtbarrel
In [26]: ang_defl/MOA
Out [26]: 30.849322114772693

Example 4—Use of Muzzle Gas to Redirect Bullet

Figure 28:
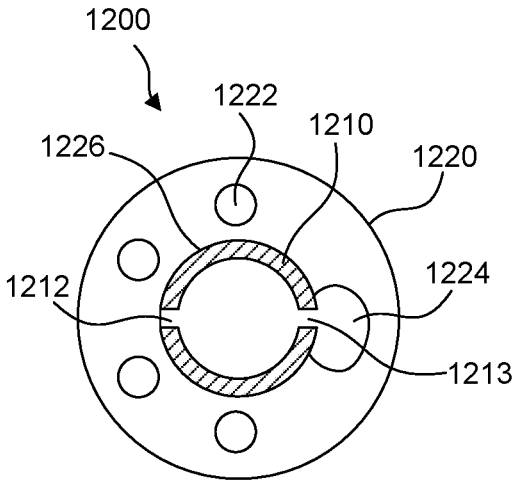
FIG. 28 shows a front view of a muzzle brake shroud secured to a muzzle brake according to the experiment of Example 4.

A commercially available off-the-shelf Kineti-Tech brand muzzle brake was used to confirm that muzzle gases can be used to change a trajectory of a projectile. The muzzle brake 1210 has external male threads for a concussion/redirector sleeve (not used). A muzzle-brake shroud and port blocker 1220, e.g., a "blocker," built from an off-the-shelf 6061 round stock and a drill press and thread tap. The blocker has several co-linear holes 1222 drilled for weight reduction and which serve no other purpose, as shown in FIG. 28. In addition, the blocker 1220 includes a main through-hole 1226, drilled and tapped, to accommodate the muzzle brake 1220, and an offset side-hole 1224 for relief of gas pressure, the "relief port." Without the relief port, all of the side-ports 1212, 1213 of the muzzle brake would be blocked. The relief port 1224 can be positioned so as to allows selective blocking of either the brake-ports on the 3-o'clock or the 9-o'clock position.

The rifle used in the test is an AR-15 w/20" SS bbl (OdinWorks) shooting 62-grain PMC X-Tac FMJ NATO 5.56×45.

The test included:

a) initial site-in and zeroing, etc. (range: 64.0 meters measured from muzzle-to-target, confirmed by a laser rangefinder, and in dry, relatively still air).
b) a test of a variety of ammo (not described), settling on PMC X-Tac 62 grain.
c) firing three shots without the blocker.
d) firing three shots with the blocker on the muzzle brake with the relief port at the 9 o'clock position (shooter's perspective).
e) firing five shots without a blocker to confirm no drift of zero.
f) firing five shots with a blocker on the muzzle brake with a relief port at the 3 o'clock position (shooter's perspective).

Figure 31:
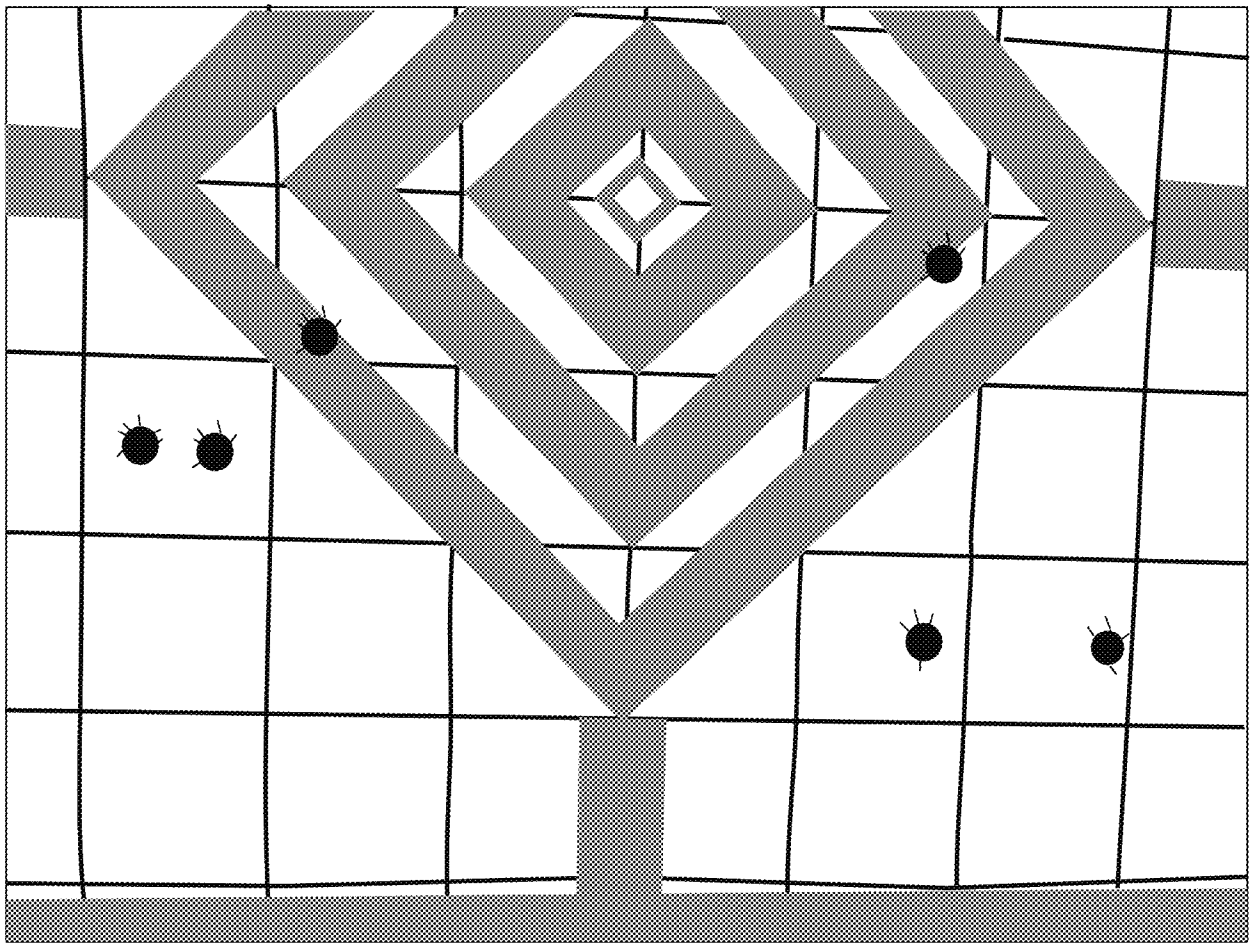
FIG. 31 shows a view of shot locations recorded for steps (c) and (d) of Example 4.
Figure 32:
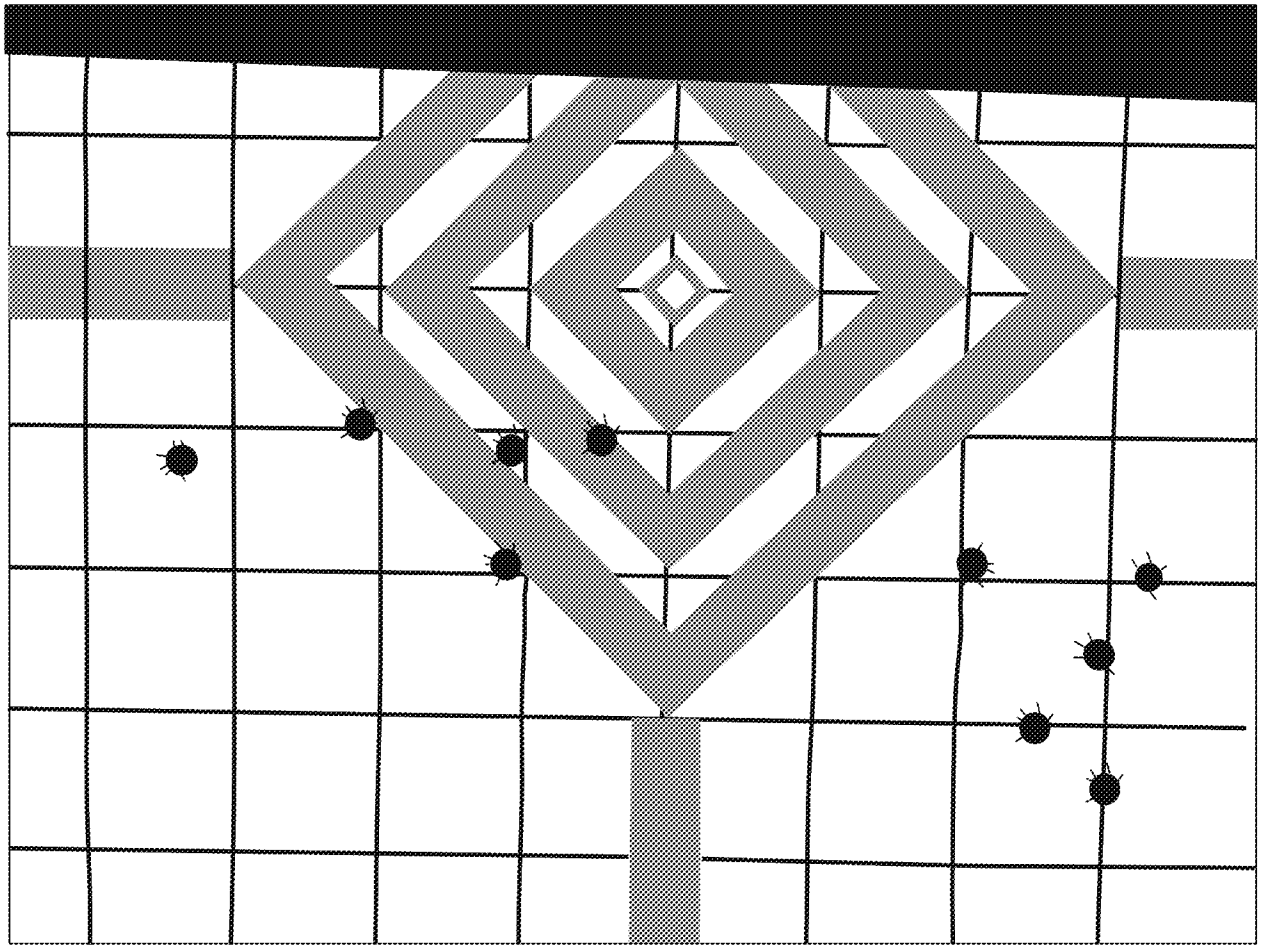
FIG. 32 shows a view of shot locations recorded for steps (e) and (f) of Example 4.

This test confirmed a sizeable change in ballistics, roughly in-line with calculations. Step (b) above confirmed 62-grain PMC X-Tac was sufficiently accurate: just under 4 cm group sizes, which is roughly a 2 inch grouping at 100 yards. Step (c) showed a relatively loose 3-shot group (5 cm at 64.0 m). Step (d) showed that the blocker shrunk the group size, and more importantly, caused a clear shift of the group to the left, as shown in FIG. 31. The shift of POI (point-of-impact) was about 4.5 inches (11.5 cm) at 64 m, corresponding to a shift of POI of 1.79 mil (6.14 MOA). Step (e) showed that with the blocker removed, the group size returned to normal, as in step (c). Step (f) showed that the group shrunk slightly, and more importantly, the POI of the group shifted to the right, by quantitatively approximately the same as the shift to the right in step (d): about 1.79 mil (6.14 MOA), as shown in FIG. 32. This proof-of-principle test confirms that the lateral forces induced by muzzle gas are sufficient to generate an offset in POI that is large enough to be useful for redirecting a projectile as described herein.

Example 5—Use of Gas Block and Gas Tubes to Redirect Projectile

Gases sourced from the barrel of the firearm are conveyed forward by means of a gas tube or tubes to a muzzle device attached to the muzzle of the gun. The muzzle device may serve as a gas manifold that redirects the gases to a point inward so as to exert an aerodynamic force on the bullet or other projectile. The test was performed with a Bushnell 3-9× scope with 40 mm objective. Range as determined by a rangefinder was 69.5±0.5 m as measured from the muzzle of the firearm to the target. The rifle used was a homebuilt AR-15 with a complete upper (OdinWorks), machined and modified, with a threaded 18" SS (416R) bbl with a nominal AR-15 design gas port located 13" from breech end. The barrel was machined to remove a boss near the gas port to enable a gas block to be installed in a reverse configuration (i.e. the gas tube pointing forward rather than towards the rear). The factory gas block was replaced with a Noveske Switchblock® switchable gas block, turned around so that gas tube would face forward rather than towards the rear. The gas tube fed into a second gas block (DPMS, chosen due to its design which does not require the gas tube to be terminated) to feed gas to gas manifold assembly. The gas tube was modified to create an additional side gas-port at a distal end of the gas tube to supply gas to a distal gas block. Gas manifold assembly consisted of gas manifold casing (303 SS), gas manifold (6061 Al), gas manifold assembly end-caps (6061 Al; proximal end-cap modified to remove interference with gas tube), and #016 Viton® O-rings. The gas manifold was fed gas via hole drilled into the gas manifold casing; gas entered a plenum inside the manifold assembly, and plenum fed gas to a linear array of eight orifices spaced 0.250" apart, for a total linear distance from first to last orifice of 1.750". Manifolds with a range of different orifice inner diameters were manufactured; due to time limitations, actual testing was performed on only one manifold, with orifices of 0.045" inner diameter.

Ammo used in the test was 5.56×45 NATO 62-grain PMC green-tip X-TAC LAP, which was found to have suitably high accuracy in this rifle.

A series of shot groups were taken with the Noveske Switchblock® alternately in the "OFF" and "ON" position (i.e. with gas not supplied to gas manifold or with gas supplied to gas manifold, respectively).

Results of the shot groups are reported below, with x-y offset position (i.e. to the right or up, from the perspective of the shooter) recorded in inches. The target consisted of a paper target, with nominal 1" squares, firmly affixed to hardboard, and hardboard firmly affixed to wooden stakes. Position of shots was determined subsequently (i.e. not in field) by digital micrometer. The results of each group are not necessarily listed below in the order the shots were taken.

Positions are recorded with respect to point-of-aim. As is normal and understood by those proficient in the art of target shooting, the actual point-of-impact will not normally coincide with the intended point-of-aim; there is virtually always a small offset, either by design or by accident. Therefore, the absolute position of each bullet impact with respect to the nominal point-of-aim has no significance. What is significant, and what is being measured, is the effect of the device under test to modify or shift the point-of-impact, dependent upon whether the Switchblock is in the "OFF" or "ON" position.

Figure 33:
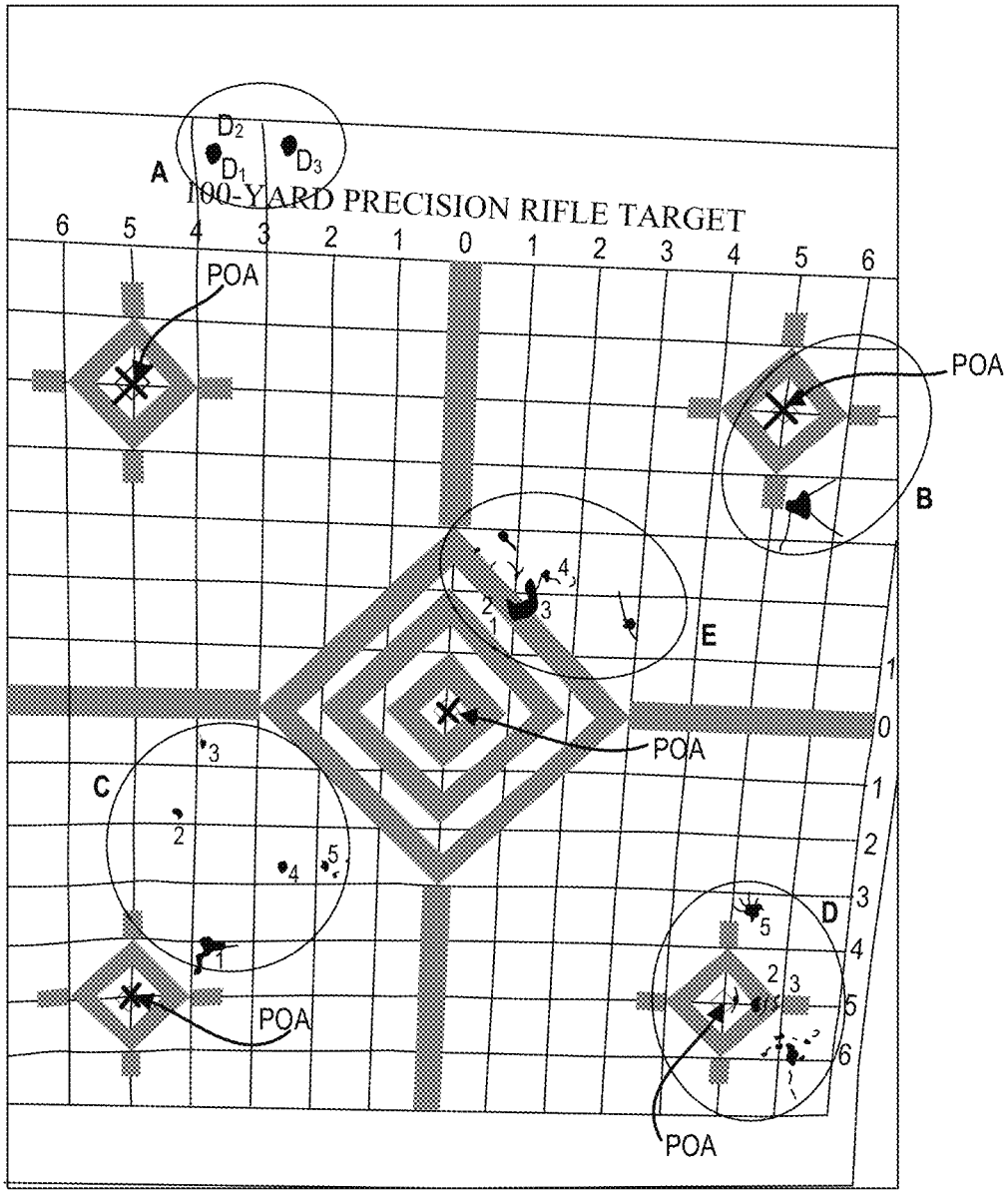
FIG. 33 shows a view of shot locations recorded for Example 5.

Two three-shot groups (control and experiment), and then two five-shot groups (control and experiment) were performed, the results of which are shown in FIG. 33. Due to a somewhat large grouping in the second five-shot control group (Shot Group C), an additional six shot group was performed. The five groups described below were performed in succession and in the order presented, e.g., Shot Group A was performed first, followed by Shot Group B, etc.

All quantities in Tables 1-5 are listed in inches, and all quantities have an error of approximately ±0.01 inch.

TABLE 1

| Shot Group A - Switchblock in off position | |
|---|---|
| x position | y position |
| 1.32 | 3.15 |
| 1.47 | 3.70 |
| 2.46 | 3.35 |

TABLE 2

| Shot Group B - Switchblock in on position | |
|---|---|
| x position | y position |
| 0.04 | −0.29 |
| 0.27 | −1.46 |
| 1.62 | 0.49 |

TABLE 3

| Shot Group C - Switchblock in off position | |
|---|---|
| x position | y position |
| 1.22 | 0.99 |
| 0.66 | 3.15 |
| 1.06 | 4.33 |
| 2.44 | 2.30 |
| 3.12 | 2.34 |

TABLE 4

| Shot Group D - Switchblock in on position | |
|---|---|
| x position | y position |
| 0.25 | 0.08 |
| 0.60 | 0.13 |
| 0.56 | −0.05 |
| 0.95 | −0.69 |
| 0.26 | 1.76 |

TABLE 5

| Shot Group E - Switchblock in off position | |
|---|---|
| x position | y position |
| 1.06 | 1.66 |
| 0.95 | 1.80 |
| 1.29 | 1.85 |
| 1.48 | 1.29 |
| 0.78 | 2.85 |
| 2.88 | 1.57 |

Statistics for each group may be calculated independently, but this is not as informative as the aggregate statistics comparing control (OFF) and experiment (ON). Results of the latter are shown in Table 6.

TABLE 6

| Aggregated Statistics from Shot Groups A-E (inches) | | |
|---|---|---|
| | Control | Experimental |
| x mean | 1.585 | 0.569 |
| x std | 0.799 | 0.510 |
| y mean | 2.452 | −0.004 |
| y std | 0.990 | 0.930 |

While the Experimental groups with the Switchblock ON (Shot Groups B and D) appear slightly tighter (smaller spread), it is not clear that this result is statistically significant.

The overall shift in point-of-impact, and the associated uncertainty in this measurement is listed below. The latter is determined by a weighted average of the control std vs. experiment std, added in quadrature.

Delta(x)=−1.016, sigma_x=0.708—this shows that the gas ("ON") shifts bullet impact to the left; this result is significant at the 1.44 sigma level (this is a measure of statistical significance).

Delta(y)=−2.456, sigma_y=0.969—this shows that the gas ("ON") shifts bullet impact down; this result is significant at the 2.53 sigma level.

These shifts correspond, at the measured distance of 69.5 m, to a shift of POI to the left of 0.37±0.26 mil (or 1.28±0.89 MOA), and a downward shift of POI by 0.898±0.354 mil (or 3.09±1.22 MOA).

In conclusion, these test results positively affirm that the physical effect of re-directing a bullet is possible. Re-direction includes a statistically-significant re-direction down, as expected, plus a smaller but also statistically-significant re-direction to the left. One possible explanation for the latter is that it may relate to Bernoulli-effect forces on the spinning bullet, due either to the bullet becoming offset with respect to the centerline of the manifold, or to the differential impact of gas impingement on the side acting on a spinning bullet.

A theoretical estimate of the re-direction of the bullet is difficult to determine, as the flow through the system is far from isentropic, due to the convoluted internal flow geometry that most likely results in substantial turbulence and deviation from ideal behavior. The flow in the gas plenum and through the showerhead orifices is most likely subsonic, as there are multiple restrictive passages upstream.

However, as an estimate of an upper limit, we can suppose that the thrust of the gas impinging on the bullet can be estimated by assuming a linear array with a total cross-sectional area equal to the area of the gas port on the rifle barrel, and assuming that at any given point, about three out of the total eight jets are impinging on the bullet, and that the lateral force due to any one individual jet is roughly comparable to the upstream static reference pressure of 10,000 psi multiplied by the area of the jet orifice. Assuming a gas port inner diameter of 0.070" for a 62-grain bullet being pushed laterally as it moves approximately 4 cm (roughly, the linear extent of the region in which the bullet it being more-or-less impacted by three jets) distance through the gas manifold, a simple calculation shows that the deflection should be about 0.7 millirad, or about 2.5 MOA, in line with observations:

```
In [1]: from math import*
In [2]: cm=1.0
  mm=0.1# cgs units
  inch=2.54
  grain=0.065# mass of grain in grams
  bar=1.0e6# cgs units
  atm=1.01*bar
  psi=atm/14.7
  Pa=10.0# Pa in cgs
  MPa=1.0e6*Pa
  kbar=1.0e3*bar
  Newton=1.0e5
  poundf=4.448*Newton
  poundm=1.0e3/2.2# a kg is 2.2 lbs
  deg=pi/180# degrees in radians
  MOA=deg/60.0
In [3]: m_bullet=62*grain
In [4]: P=10,000.0*psi
In [5]: #A=0.3*(mm*2) # rough area of hole
  A1=(pi/4.0)*(0.045*inch)**2# area of one hole
  Aeff=3*A1# roughly three holes impinge on bullet at a
    time
  Atot=8* A1
  Agasport=(pi/4)*(0.070 inch)**2
  print (Atot/Agasport)=3.306122448979591
In [6]: Aeff2=(3.0/8.0)*(pi/4.0)*(0.070*inch)**2#
  assume 3 out of 8 gas jets hitting bullet at a given time
In [7]: print (Aeff2/Agasport)=0.375
In [8]: F=P*Aeff2
In [9]: a=F/m_bullet
In [10]: v0=950*1.0e2# speed of bullet
In [11]: # dt=(5*cm)/v0
dt=(4*cm)/v0# effective distance over which three holes
  impinge on bullet is closer to 4 cm rather than 5 cm
In [12]: dv=a*dt
In [13]: ang_defl=dv/v0
In [14]: print (angl_defl*1000.0) # get angular deflection
  in milliradians=0.70355
In [15]: print (angl_defl/MOA)=2.4186349195438646
```

Example 6—Inertial Aim-Stabilization Algorithm

Humans experience a physiological tremor while holding an object. The basic equation for a noise-driven damped harmonic oscillator can be described as:

$$m\frac{d^2}{dt^2}x + b\frac{d}{dt}x + kx = f(t)$$

where f(t) is the forcing term. The purpose is to describe algorithms in simple terms. A simple first-order leapfrog time integration is implemented here. Units may be arbitrarily chosen as the purpose is to demonstrate the smoothing algorithm, for understanding, the units of the time-axis may be thought of as being in seconds and the units of the x and y axes may be in milliradians. If the marksman initially takes aim at position x=0 and y=0, and at time t=60, the marksman shifts aim to a target at x=10.0 and y=0. Below is shown the response of the filter (herein implemented digitally, although a similar filter can be implemented as an analog computer), as well as the offset correction. This offset correction is the shift in x and y for the invention to apply to the bullet so as to bring the raw position closer to the filtered position at the target.

```
In [22]: m=1.0
  b=1.0
  k=1.0
  mu=0.0
  sigma=5.0
In [23]: X=[[0.0, 0.0, 1.0]]
  Y=[[0.0, 0.0, 1.0]]
In [24]: dt=1.0e-2
  N=9000
  Nskip=1000
In [25]: def asmooth(x,v,x0=0.0):
  # returns the smooth (non-stochastic) acceleration due
    to spring and damping
  f=−b*v−k*(x−x0)
  f=−b*v−k*np.sign(x−x0)*abs(x−x0)**1.8
  return f/m
  def atot(x,v,x0):
  arand=np.random.normal(mu,sigma)
  return asmooth(x,v,x0)+arand
  for i in range(N):
  t=X[−1][0]
  if (t<60.0):
  x0=0.0
```

```
else:
x0=10.0
x=X[-1][1]
vx=X[-1][2]
dx=vx*dt
ax=atot(x+0.5*dx,vx,x0)
dvx=ax*dt
X.append([t+dt,x+dx,vx+dvx])
y=Y[-1][1]
vy=Y[-1][2]
dy=vy*dt
ay=atot(y+0.5*dy,vy,0.0)
dvy=ay*dt
Y.append([t+dt,y+dy,vy+dvy])
```

In [26]: X_=np.array(X);
Y_=np.array(Y);

In [27]: plt.plot(X_[Nskip:,0],X_[Nskip:,1],Y_[Nskip:,0],Y_[Nskip:,1])
Trace of x-position vs time and y-position versus time
Out[27]: [<matplotlib.lines.Line2D at 0x7fc27afa9978>, <matplotlib.lines.Line2D at 0x7fc27afa9b00>]

Figure 35:
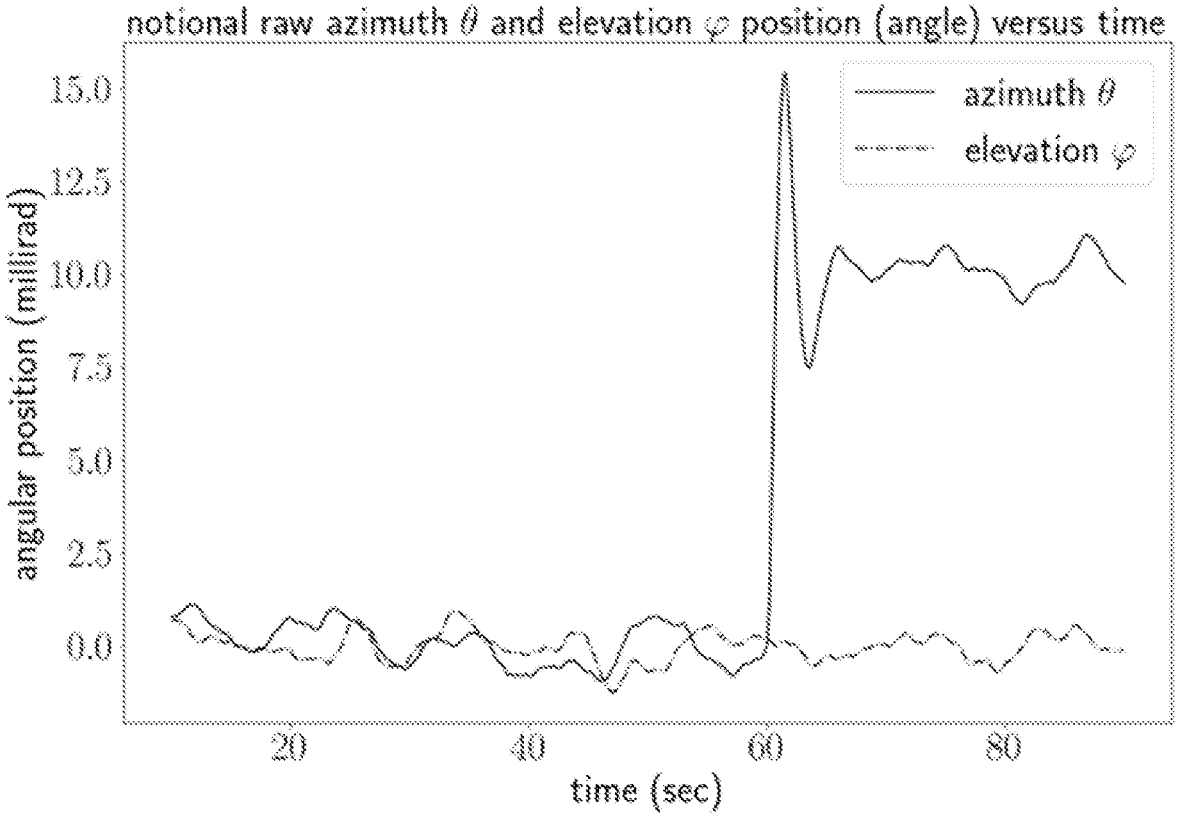
FIG. 35 shows a graph of the x and y positions vs. time.

A graph of the x and y positions vs. time is shown in FIG. 35.

The array $x_s$ is the running exponentially-weighted average of x (and likewise for y):

$$x_s(t) = \frac{1}{\tau}\int_0^{\infty} x(t-t')\exp\left(-\frac{t'}{t}\right)dt'$$

In fact, such a smoothing process, in the method as implemented digitally below, is computationally-intensive. However, the algorithm can be re-factored to make it more efficient.

```
In [28]: tau=3.0
In [29]: Xs=[[0.0,0.0]] # time t and position x
  for i in range(N):
    t=X_[i,0]
    xs=0.0
  for j in range(i):
    t1=X_[j,0]
    deltat=t-t1
    x=X_[j,1]
    xs+=x*exp(-deltat/tau)tau*dt
    Xs.append([t,xs])
  Xs_=np.array(Xs)
In [30]: Ys=[[0.0,0.0]] # time t and position x
  for i in range(N):
    t=Y_[i,0]
    ys=0.0
    for j in range(i):
    t1=Y_[j,0]
    deltat=t-t1
    y=Y_[j,1]
    ys+=y*exp(-deltat/tau)/tau*dt
    Ys.append([t,ys])
  Ys=np.array(Ys)
In [31]: plt.xlabel('time')
  plt.ylabel('horizontal position')
  N0=1000; N1=6000;
  plt.plot(X_[N0:N1,0],X_[N0:N1,1],label='raw signal')
  plt.plot(Xs_[N0:N1,0],Xs_[N0:N1,1],label='smoothed signal')
  plt.title('Raw Signal and Smoothed Signal')
  plt.legend( )
```

The first 10-60 trace of the x-position, raw signal, and the smoothed signal

Out[31]: <matplotlib.legend.Legend at 0x7fc278cc4710>

Figure 36:
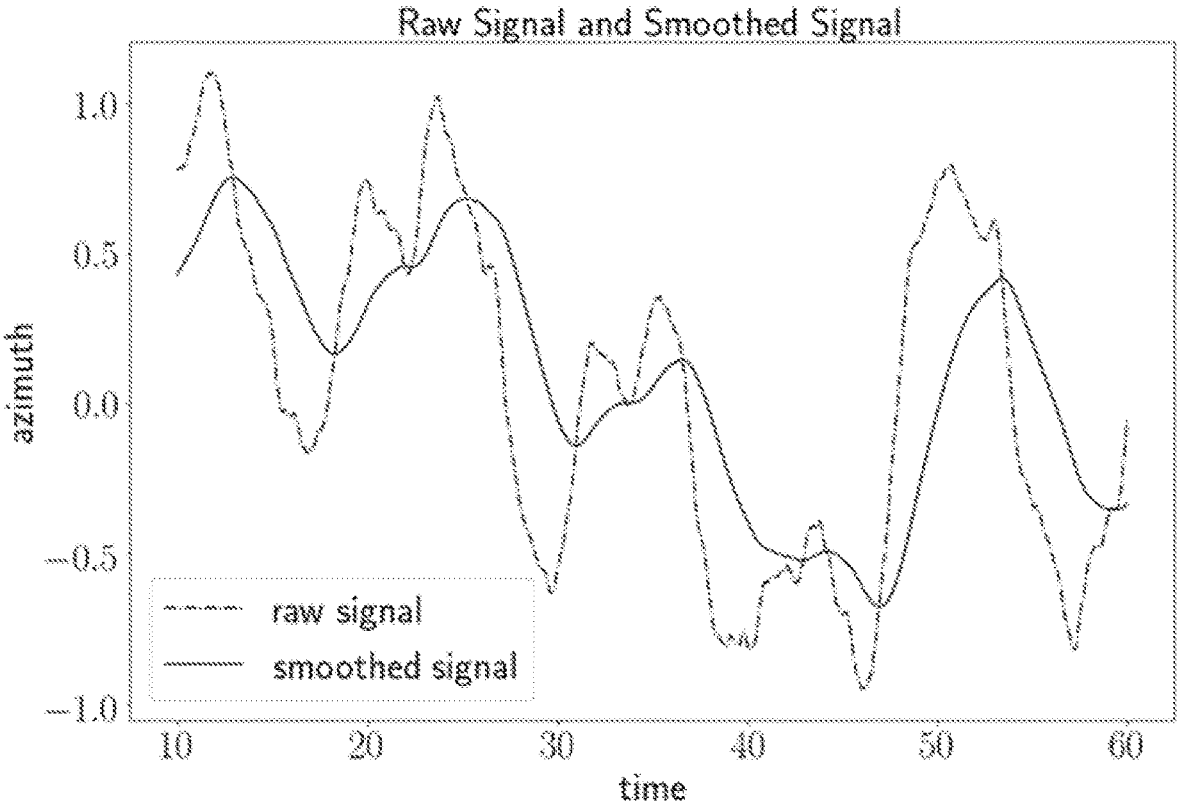
FIG. 36 shows a graph of the raw signal and smooth signal plotted as horizontal position vs. time.

A graph of the raw signal and smooth signal plotted as horizontal position vs. time is shown in FIG. 36.

```
In [32]: plt.xlabel('time')
  plt.ylabel('horizontal position')
  N0=1000; N1=6000;
  plt.plot(X_[N0:N1,0],X_[N0:N1,1],label='raw signal')
  plt.plot(Xs_[N0:N1,0],Xs_[N0:N1,1],label='smoothed signal')
  plt.plot(X_[N0:N1,0],Xs_[N0:N1,1]-X_[N0:N1,1], label='offset')
  plt.legend( )
  plt.title('Showing offset (correction) to be applied by invention')
```

Out[32]: Text(0.5, 1.0, 'Showing offset (correction) to be applied by invention')

Figure 37:
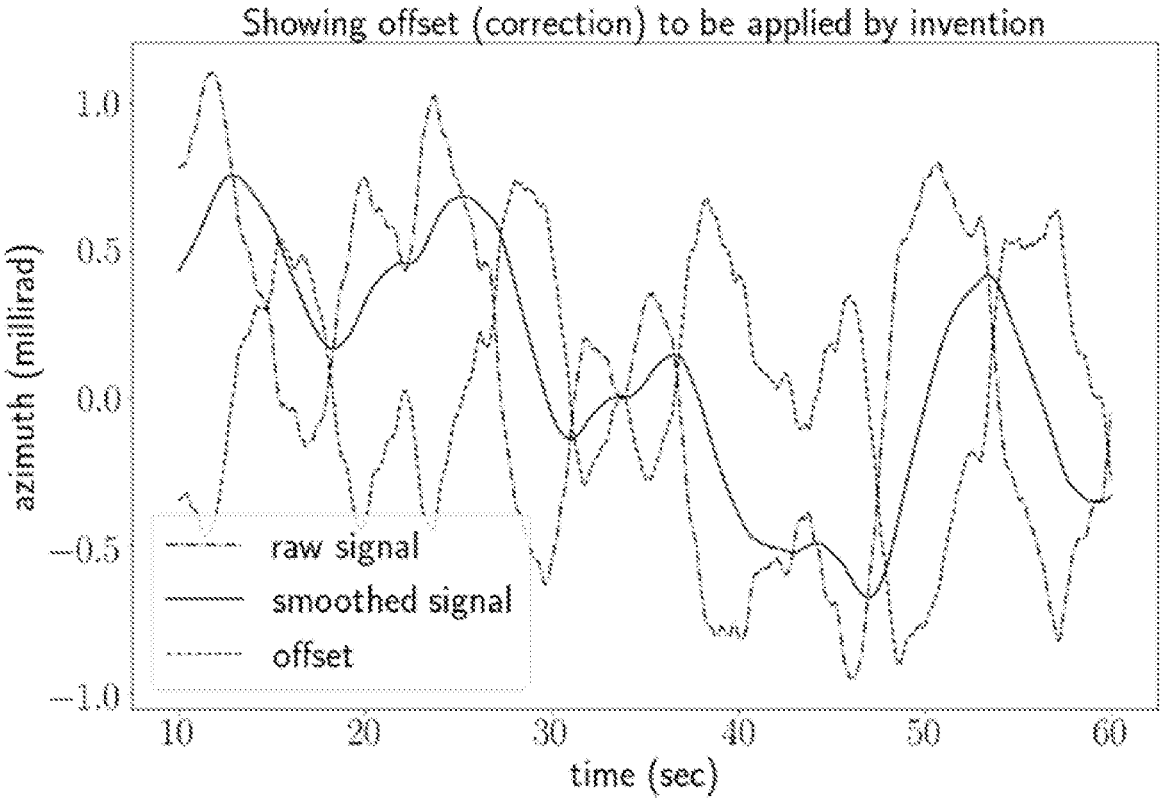
FIG. 37 shows a graph of the correction to be applied to raw signal based on smoothed signal plotted as horizontal position vs. time.

A graph of the correction to be applied to raw signal based on smoothed signal plotted as horizontal position vs. time is shown in FIG. 37.

```
In [33]: plt.xlabel('time')
  plt.ylabel('horizontal position')
  N0=1000;
  plt.plot(X_[N0:,0],X_[N0:,1],label='raw signal')
  plt.plot(Xs_[N0:,0],Xs_[N0:,1],label='smoothed signal')
  plt.title('Raw Signal and Smoothed Signal')
  plt.legend( )
```

Out[33]: <matplotliblegend.Legend at 0x7fc2787b0f60>

Figure 38:
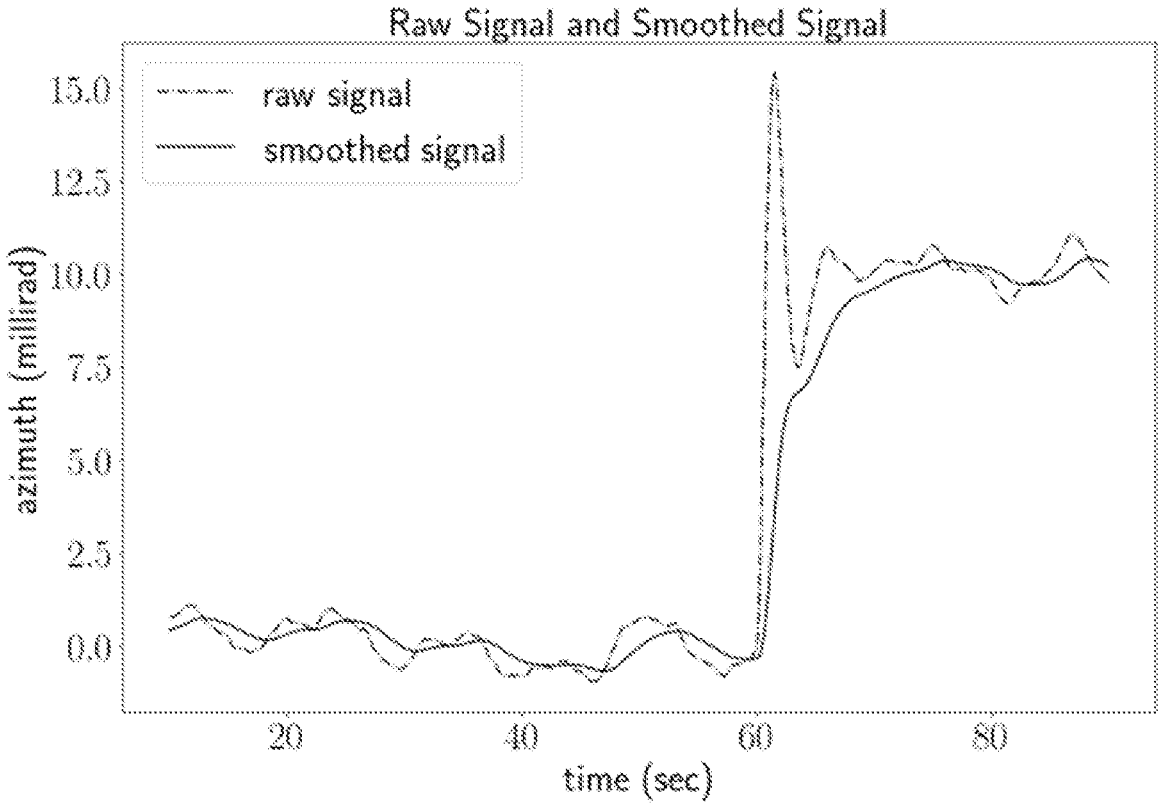
FIG. 38 shows a graph of the raw signal and smooth signal plotted as horizontal position vs. time.

A graph showing the raw signal and smooth signal plotted as horizontal position vs. time is shown in FIG. 38.

```
In [34]: #fig, ax=plt.subplots(1,1)
  plt.axes( ).set_aspect('equal')
  plt.xlabel('horizontal position')
  plt.ylabel('vertical position')
  N0=1000; N1=6000
  plt.plot(X_[N0:N1,1],Y_[N0:N1,1],label='raw signal')
  plt.plot(Xs_[N0:N1,1],Ys_[N0:N1,1],label='smoothed signal')
  plt.title('Raw Signal and Smoothed Signal: Trace at Target')
  #matplotlib.axes.Axes.set_aspect(aspect='equal')
  plt.legend( )
```

Out[34]: <matplotliblegend.Legend at 0x7fc278717e48>

Figure 39:
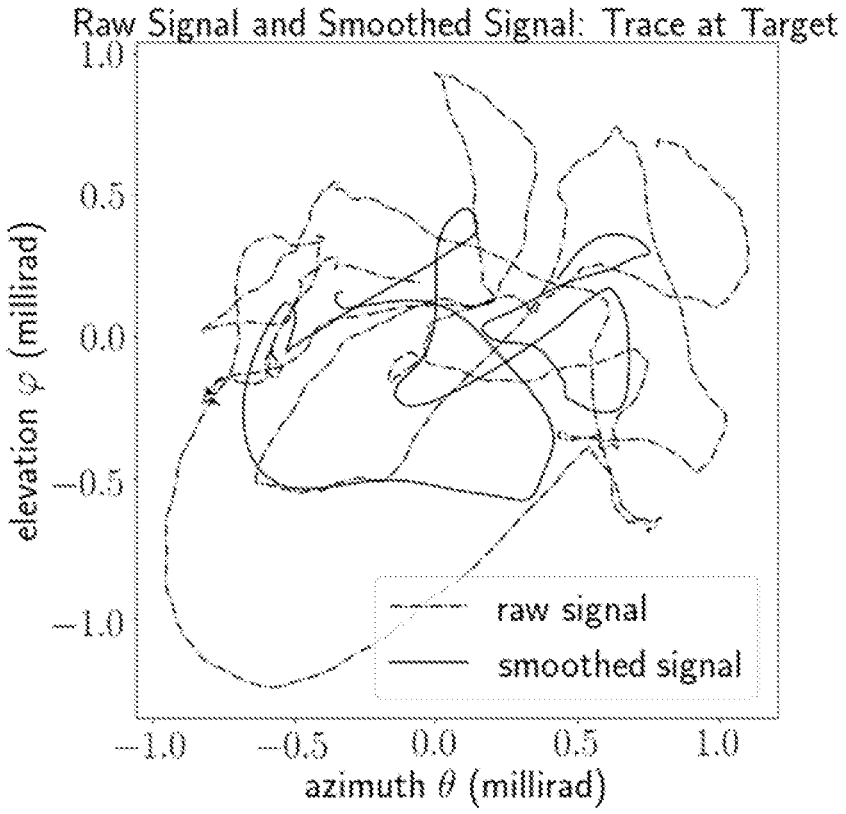
FIG. 39 shows a graph of the raw signal and smoothed single trace at target plotted as vertical vs. horizontal positions.

A graph showing the raw signal and smoothed single trace at target plotted as vertical vs. horizontal positions is shown in FIG. 39.

```
In [35]: plt.axes( ).set_aspect('equal')
  plt.xlabel('horizontal position')
  plt.ylabel('vertical position')
  N0=1000;
  plt.plot(X_[N0:,1],Y_[N0:,1],label='raw signal')
  plt.plot(Xs_[N0:,1],Ys_[N0:,1],label='smoothed signal')
  plt.title('Raw Signal and Smoothed Signal: Trace at Target, w/re-target'))
  #matplotlib.axes.Axes.set_aspect(aspect='equal')
  plt.legend( )
```

Out[35]: Text(0.5, 1.0, 'Raw Signal and Smoothed Signal: Trace at Target, w/re-target')

Figure 40:
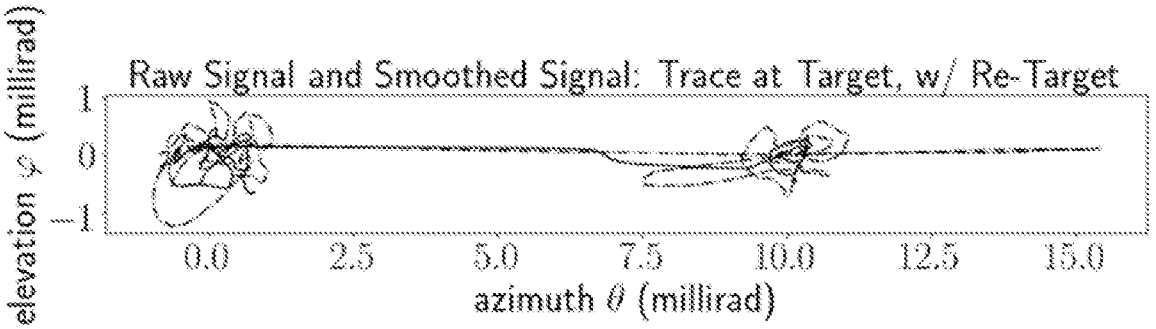
FIG. 40 shows a graph of the raw signal and smoothed signal trace at target plotted as vertical position vs. horizontal position.

A graph showing the raw signal and smoothed signal trace at target plotted as vertical position vs. horizontal position is shown in FIG. 40.

The graphs shown in FIGS. 39 and 40 show how the filtering algorithm is able to take the raw position information and smooth it to create a simple estimate of what the marksman's intended point of aim, and to generate an offset to apply (not shown here, but difference between the two lines) in order to correct the aim of the rifle in accordance with this estimate.

What is claimed is:

1. A firearm having an aim-compensation system, comprising:

a firearm having a barrel, wherein the firearm is configured to fire a projectile;

a sensor disposed on the firearm that is configured to determine an orientation of the firearm;

a control unit configured to determine an intended point-of-aim of the firearm and an actual point-of-aim of the firearm based on the orientation of the firearm as determined by the sensor, wherein the control unit determines a differential of the intended point-of-aim and the actual point-of-aim; and a muzzle device arranged on the barrel of the firearm, wherein the muzzle device is in communication with the control unit, and wherein, when the projectile is fired, the muzzle device is configured to direct a gas toward the projectile in an amount and direction based on the differential determined by the control unit so as to exert an aerodynamic force on the projectile to alter the trajectory of the projectile towards the intended point-of-aim.

2. The firearm of claim 1, wherein the firearm is a rifle.

3. The firearm of claim 1, wherein the intended point-of-aim is estimated by the control unit based on measurements of the orientation of the firearm over a period of time.

4. The firearm of claim 1, wherein the sensor is selected from an inertial sensor and an optical sensor.

5. The firearm of claim 4, wherein the sensor is an optical sensor, and the optical sensor is incorporated in a riflescope of the firearm.

6. The firearm of claim 1, wherein the muzzle device comprises an outer cylinder spaced from an inner cylinder, wherein the inner cylinder comprises a plurality of orifices that are selectively covered by valve gates configured to modulate a flow of gas through the plurality of orifices.

7. The firearm of claim 1, wherein the muzzle device comprises a cylindrical muzzle shroud having orifices and a valve gate plate having orifices, wherein the valve gate plate is configured to be linearly actuated so as to selectively align the orifices of the valve gate plate with the orifices of the cylindrical muzzle shroud so as to modulate a flow of gas through the orifices of the cylindrical muzzle shroud.

8. The firearm of claim 1, wherein the muzzle device comprises an outer cylinder and an inner gas guide cylinder supported within the outer cylinder by an active motor assembly configured to selectively position the inner gas guide cylinder within the outer cylinder.

9. The firearm of claim 1, wherein the muzzle device comprises conical baffles adjustably positioned within an outer cylinder.

10. The firearm of claim 1, further comprising a gas piston block configured to receive gas from the barrel via a gas port, wherein the gas piston block is configured to actuate push rods that are connected to the muzzle device for modulating a flow of gas through the muzzle device.

11. The firearm of claim 10, wherein the muzzle device comprises a baffle cone body that is actuated by the push rods.

12. The firearm of claim 1, further comprising a gas block multiplexer configured to receive gas from the barrel and distribute the gas via gas tubes to the muzzle device.

13. The firearm of claim 1, wherein the muzzle device comprises nozzles and electromechanical valves that modulate a flow of gas through the nozzles.

14. The firearm of claim 1, wherein the muzzle device comprises nozzles and virtual control surfaces for modulating a flow of gas through the nozzles.

15. The firearm of claim 1, wherein the muzzle device comprises nozzles, and each of the nozzles comprises a divergent section and a convergent section.

16. The firearm of claim 1, further comprising a gas filter block configured to filter particulate from gas received from a gas block of the firearm via a gas tube.

17. A method of aim-compensation for a firearm, comprising:

determining, by means of a sensor arranged on the firearm, a first orientation of the firearm corresponding to an intended point-of-aim;

determining, by means of the sensor arranged on the firearm, a second orientation of the firearm at a time the firearm is fired;

determining, by means of a control unit of the firearm, a differential between the first orientation and the second orientation; and inducing, by means of a muzzle device of the firearm, an aerodynamic force on the projectile by directing a gas toward the projectile in an amount and direction based on the differential determined by the control unit such that a trajectory of the projectile is altered to direct the project toward the intended point-of-aim.

* * * * *